US006905758B1

(12) United States Patent
Kushida et al.

(10) Patent No.: US 6,905,758 B1
(45) Date of Patent: Jun. 14, 2005

(54) DECORATIVE ITEM AND PROCESS FOR PRODUCING THE SAME

(75) Inventors: Hachirou Kushida, Tokyo (JP); Kenji Hanai, Tokyo (JP); Yoshitugu Andou, Tokyo (JP); Takeshi Inoue, Tokyo (JP); Kazumi Hamano, Tokyo (JP); Yukio Tanokura, Tokyo (JP); Akira Meguro, Tokyo (JP); Shinji Ikeda, Kitakami (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/831,327

(22) PCT Filed: Sep. 7, 2000

(86) PCT No.: PCT/JP00/06086

§ 371 (c)(1),
(2), (4) Date: May 7, 2001

(87) PCT Pub. No.: WO01/18275

PCT Pub. Date: Mar. 15, 2001

(30) Foreign Application Priority Data

| | | |
|---|---|---|
| Sep. 7, 1999 | (JP) | 11/252900 |
| Nov. 10, 1999 | (JP) | 11/319437 |
| Apr. 6, 2000 | (JP) | 2000-104454 |

(51) Int. Cl.[7] ..... C23C 8/20

(52) U.S. Cl. ..... 428/212; 428/217; 428/469; 428/472; 428/678

(58) Field of Search ..... 428/469, 472, 428/212, 267, 696, 698, 217, 216, 336; 148/206, 217; 427/532, 299, 318, 402

(56) References Cited

U.S. PATENT DOCUMENTS

| | | | | |
|---|---|---|---|---|
| 3,772,096 | A | * | 11/1973 | Maquelin |
| 4,507,184 | A | * | 3/1985 | Murata |
| 4,699,850 | A | * | 10/1987 | Kishi et al. |
| 4,791,017 | A | * | 12/1988 | Hofmann et al. |
| 5,292,555 | A | * | 3/1994 | Preisser |
| 5,556,483 | A | * | 9/1996 | Tahara et al. |
| 5,593,510 | A | * | 1/1997 | Tahara et al. |
| 5,792,282 | A | | 8/1998 | Tahara et al. |
| 6,093,303 | A | * | 7/2000 | Williams et al. |

FOREIGN PATENT DOCUMENTS

| | | | |
|---|---|---|---|
| JP | 51059732 | * | 5/1976 |
| JP | 51059733 | * | 5/1976 |
| JP | 52082642 | * | 7/1977 |
| JP | 54(1979)-086441 | | 7/1979 |
| JP | 56008004 | * | 1/1981 |
| JP | 57072605 | * | 5/1982 |
| JP | 57098671 | * | 6/1982 |
| JP | 58199858 | * | 11/1983 |
| JP | 09(1997)-071854 | | 3/1997 |
| JP | 09(1997)-268364 | | 10/1997 |
| JP | 09(1997)-302456 | | 11/1997 |

* cited by examiner

*Primary Examiner*—Archene Turner
(74) *Attorney, Agent, or Firm*—Webb Ziesenheim Logsdon Orkin & Hanson, P.C.

(57) ABSTRACT

A decorative item and method for making same, such as an exterior part of a timepiece, wristwatch band and the like, includes a basis material of stainless steel having a carburized hardened later thereon in which carbon is diffused so as to form a solid solution in which crystalline chromium carbide is not formed and at least one hard coating is deposited on the carburized hardened layer of basis material, wherein the hard coating has a surface hardness greater than that of the carburized layer.

46 Claims, 7 Drawing Sheets

DECORATIVE ITEM AND PROCESS FOR PRODUCING THE SAME

TECHNICAL FIELD

The present invention relates to a decorative item (including parts) and a process for producing the same. More particularly, the present invention primarily relates to a decorative item, such as an exterior part of a timepiece, in which use is made of a base material having a hardened layer, for example, a carburized (cemented) layer extending from a surface thereof to an arbitrary depth wherein a solute atom is diffused so as to form a solid solution, and relates to a process for producing the decorative item. Further, the present invention is concerned with an exterior part of a timepiece constituted by a carburized stainless steel, especially an exterior part of a timepiece, such as a wristwatch band, bezel, casing, back lid or dial, constituted by a gas carburized austenitic stainless steel, and is concerned with a process for producing the same. Still further, the present invention is concerned with an exterior part of a timepiece having a smooth or specular surface free of what is known as "orange peel" and with a process for producing the same.

BACKGROUND OF THE INVENTION

In a decorative item, for example, an exterior part (member) of a timepiece, such as a wristwatch band, bezel, casing, back lid, buckle or dial, use is made of stainless steel, titanium or a titanium alloy. In particular, austenitic stainless steel which is excellent in corrosion resistance and ornamental capacity is widely employed as the stainless steel.

For example, a plate of austenitic stainless steel SUS 316 or SUS 304 is subjected to cold forging. The forged plate is arbitrarily cut or drilled (punched) and finished into the shape of wristwatch band piece. The thus obtained band pieces are connected to each other to obtain a completed wristwatch band.

However, the austenitic stainless steel has a drawback in that its specular surface is easily scratched to cause the appearance of the wristwatch band, bezel, casing, back lid, dial or other exterior part of a timepiece constituted by the austenitic stainless steel per se to easily deteriorate.

The technology of carburizing the surface of stainless steel such as austenitic stainless steel to harden the stainless steel surface is now being studied in order to resolve the above drawback. However, the carburized stainless steel surface suffers from generation of a strain in the crystal lattice of stainless steel because of the penetration of carbon atoms to become a rough surface. Thus, also, the technology of further polishing the carburized stainless steel surface into a specular surface is being investigated.

For example, in Japanese Patent Laid-open Publication No. 54(1979)-86441, it is described that a specular surface can be easily obtained by subjecting fine precision parts, such as a gear, a spring and a shaft, constituted by a low carbon steel, a low alloy case hardening steel or the like, although there is no description of austenitic stainless steel, to pack carburizing (solid carburizing) at 900° C. and thereafter subjecting the surface of such parts to barrel polishing.

However, when a metal having a high content of chromium, such as austenitic stainless steel, is carburized at high temperatures such as 700° C. or above, chromium carbide is precipitated in a surface portion of stainless steel. As a result, the chromium content of stainless steel per se is reduced to cause the corrosion resistance of the stainless steel to extremely deteriorate. Further, the chromium carbide becomes bulky, thereby posing such a problem that the carburized region of stainless steel cannot have high hardness.

The method of carburizing austenitic stainless steel at low temperatures such as less than 700° C. for the purpose of avoiding the above precipitation of chromium carbide can be contemplated. However, when the carburization is conducted at such low temperatures, a passive film which hinders the penetration of carbon atoms is formed on the surface of stainless steel to thereby disenable hardening of the stainless steel surface.

In recent years, the technology of hardening a surface of austenitic stainless steel while maintaining the excellent corrosion resistance of the austenitic stainless steel is being investigated. For example, in the technology disclosed in Japanese Patent Laid-open Publication Nos. 9(1997)-71854, 9(1997)-268364 and 9(1997)-302456, austenitic stainless steel is fluorinated in a fluorogas atmosphere at low temperatures such as 300 to 500° C. to convert the above passive film to a fluorinated film through which carbon atoms can be easily penetrated. The fluorinated austenitic stainless steel is sequentially subjected to gas carburizing in a carburizing gas atmosphere at low temperatures such as 400 to 500° C. and to pickling or mechanical polishing (for example, soft blasting, barrel polishing or buffing).

In the thus-obtained decorative item, for example, a wristwatch band, a hardened layer, i.e., carburized layer extending from a surface of austenitic stainless steel as a base material to a depth of 5 to 50 $\mu$m is formed while maintaining the corrosion resistance thereof. Therefore, not only does the base material exhibit a beautiful specular surface but also the specular surface has a Vickers hardness (HV) as high as 500 to 700, which cannot be attained by stainless steel provided with no surface hardening treatment.

The decorative item (including personal ornament) constituted by the austenitic stainless steel having its surface hardened is resistant to scratching, so that there is an advantage such that the beauty thereof can be maintained for a prolonged period of time.

However, even if the decorative item whose base material is constituted by the above stainless steel having its surface hardened sometimes suffers from scratching when a sharp intense external force is applied thereto.

Therefore, there is a demand for the development of a decorative item whose base material is constituted by stainless steel having a higher surface hardness, i.e., greater scratch resistance than that of the conventional decorative item, and also for the development of a process for producing such a decorative item.

On the other hand, with respect to the decorative item such as an exterior part of wristwatch or a bracelet, it, as a personal ornament, must have the same ornamental value as those of other decorative items. Accordingly, the personal ornament at its surface is often furnished with an ornamental coating. For example, a gold alloy coating formed by wet plating is widely employed as such an ornamental coating.

However, the gold alloy coating is soft and easily scratched. Accordingly, even if the hardened base material surface of a personal ornament is covered with the soft gold alloy coating, the gold alloy coating would be scratched, spoiling its beauty as a decorative item. This personal ornament has a drawback in that the above advantage of hardening of the base material surface cannot be utilized.

Therefore, there is a demand for the development of a decorative item whose surface hardness as measured from the surface of gold alloy coating is large even if the gold alloy coating per se is soft, that is, a decorative item which is excellent in scratch resistance, and for the development of a process for producing the same.

In the technology described in Japanese Patent Laid-open Publication Nos. 9(1997)-71854, 9(1997)268364 and 9(1997)-302456, austenitic stainless steel is carburized at low temperature, so that precipitation and bulking of chromium carbide in stainless steel would not occur. However, a layer wherein, mainly, Fe and C in stainless steel are simultaneously present, possibly "mill scale (roll scale, black scale)" containing an iron oxide such as $Fe_2O_3$, is formed on an outermost surface of carburized layer. In the technology described in the above literature, the mill scale is removed by pickling or mechanical polishing.

However, with respect to the exterior part of a timepiece constituted by stainless steel which has been gas carburized at low temperature as mentioned above, completely removing the mill scale formed on the surface thereof so as to render the exterior part of the surface specular cannot be accomplished only by performing mechanical polishing such as barrel polishing or buffing. The reason is that most timepiece exterior parts have a complex configuration because of the attainment of ornamental beauty with the result that there are places which cannot be polished, such as the inside wall of holes and inside the wall and bottom of recessed portions. Further, with respect to timepiece exterior parts comprising a plurality of parts connected to each other, it is difficult to polish part interfaces. For example, with respect to a wristwatch band comprising a multiplicity of band pieces connected to each other by means of connecting parts, the smaller the interstice of mutually neighboring band pieces, the more difficult the polishing thereof.

Moreover, the surface of timepiece exterior parts cannot also be rendered specular only by pickling. In the pickling described in the above literature, iron contained in the mill scale is leached with a strong acid solution to remove the mill scale from the surface of timepiece exterior parts. However, iron is also contained in stainless steel per se, so that the surface of carburized layer is corroded by the strong acid solution. As a result, the surface of carburized layer after pickling is roughened and cannot be specular.

Furthermore, finishing to be effected on the surface of timepiece exterior parts constituted by stainless steel is not limited to specular finishing. For realizing an ornamental beauty, various mechanical finishings are required. For example, hairline finishing wherein a multiplicity of mutually parallel nicks are engraved or honing wherein a multiplicity of fine recesses are engraved is required.

However, the carburized stainless steel has a drawback in that its surface is so hard that it is difficult to effect the above mechanical finishing thereon.

Therefore, there is a demand for the development of an exterior part of a timepiece constituted by stainless steel such as austenitic stainless steel which is excellent in scratch resistance and has a specular surface without detriment to the inherent excellent corrosion resistance of stainless steel; the development of an exterior part of the timepiece constituted by stainless steel such as austenitic stainless steel which is excellent in scratch resistance and has its surface provided with mechanical finishing such as hairline finishing or honing without detriment to the inherent excellent corrosion resistance of stainless steel; and the development of a process for producing such timepiece exterior parts.

The timepiece exterior parts, for example, band pieces gas carburized at low temperatures such as 400 to 500° C. as mentioned above are not furnished with a beautiful specular surface required for exterior ornamentation of timepieces, and the surface thereof is observed as "orange peel" having fine unevennesses, despite the implementation of polishing.

The reason is that, by the gas carburization, a greater amount of carbon is diffused within the metal crystal grains of the stainless steel surface than in the metal crystal grain boundaries. That is, when carbon penetrates the metal crystal grains, the metal crystal grains become bulky and swell outward with the result that a thickness difference occurs between the crystal grains and the crystal grain boundaries. When viewed from the surface of the stainless steel, the crystal grains are higher than the crystal grain boundaries.

The above height difference between the crystal grains and the crystal grain boundaries cannot be eliminated despite the implementation of a sequence of treatments after the gas carburization, including pickling and mechanical polishing. As a result, the crystal grains are likely to be recognized as being lifted from the surface of stainless steel, and a multiplicity of lifted crystal grains are observed as fine unevennesses of stainless steel surface, i.e., "orange peel".

This "orange peel" is a phenomenon which commonly occurs when not only stainless steel but also titanium, a titanium alloy or other metals for use in exterior ornamentation of timepieces are subjected to surface hardening, for example, carburizing at a temperature which is close to the recrystallization temperature of the metal or below. In particular, the orange peel is a phenomenon which occurs when surface hardening is performed at below a temperature slightly over the recrystallization temperature of the metal.

Further, this "orange peel" is not limited to carburization wherein carbon is used as a solute atom, and is a phenomenon which commonly occurs when surface hardening is performed with the use of nitrogen or oxygen as a solute atom at temperature which is close to the recrystallization temperature of the employed metal or below.

Accordingly, there is a demand for the development of an exterior part of a timepiece with an excellent appearance, constituted by a metal which has a smooth or specular surface free of "orange peel" even if the metal is subjected to surface hardening at a temperature which is close to the recrystallization temperature of the metal or below; and for the development of a process for producing such an exterior part of the timepiece.

It is an object of the present invention to solve the above problems of the prior art and to provide a decorative item comprising a base material having a hardened layer, for example, a carburized layer extending from a surface thereof to an arbitrary depth, the base material surface having a higher surface hardness, i.e., greater scratch resistance than that of the conventional decorative item, especially an exterior part of a timepiece with such a characteristic.

It is another object of the present invention to provide a decorative item comprising the above base material with a hardened layer, the decorative item having a surface furnished with a golden color or other various tones without any lowering of surface hardness, i.e., without detriment to the scratch resistance thereof, especially an exterior part of the timepiece with such a characteristic.

It is an additional object of the present invention to provide processes for producing the above decorative items.

Further objects of the present invention are to provide an exterior part of a timepiece constituted by stainless steel such as austenitic stainless steel which is excellent in scratch resistance and has a specular surface without detriment to the inherent excellent corrosion resistance of stainless steel;

to provide an exterior part of a timepiece constituted by stainless steel such as austenitic stainless steel which is excellent in scratch resistance and has its surface provided with mechanical finishing such as hairline finishing or honing without detriment to the inherent excellent corrosion resistance of stainless steel; and to provide a process for producing such timepiece exterior parts.

It is a still further object of the present invention to provide an exterior part of a timepiece with an excellent appearance, constituted by a metal which has a smooth or specular surface free of "orange peel" even if the metal is subjected to surface hardening at a temperature which is close to the recrystallization temperature of the metal or below; and to provide a process for producing such an exterior part of a timepiece.

SUMMARY OF THE INVENTION

The decorative item of the present invention comprises:

a base material having a hardened layer extending from a surface thereof to an arbitrary depth wherein a solute atom is diffused so as to form a solid solution; and at least one hard coating disposed on a surface of the hardened layer of the base material.

The solute atom is generally at least one atom selected from the group consisting of carbon, nitrogen and oxygen atoms.

The base material is pr4eferably constituted of stainless steel, titanium or a titanium alloy.

The hard coating and the base material at its surface may exhibit respective tones which are different from each other.

The hard coating preferably has a surface hardness greater than that of the base material.

It is preferred that the hard coating be constituted of a nitride, carbide, oxide, nitrido-carbide or nitrido-carbido-oxide of an element belonging to Group 4a, 5a or 6a of the periodic table.

The hard coating is preferably a hard coating of carbon.

An intermediate layer may be disposed between the hard coating of carbon and a surface of the hardened layer of the base material.

It is preferred that the intermediate layer comprise a lower layer of Ti or Cr disposed on the hardened layer surface of the base material and an upper layer of Si or Ge disposed on a surface of the lower layer.

In the decorative item of the present invention, at least two hard coatings may be formed on the hardened layer surface of the basis base material, or at least two hard coatings may be laminated on the hardened layer surface of the base material.

Further, in the decorative item of the present invention, the hard coating may be disposed on a portion of the hardened layer surface of the base material.

The decorative item of the present invention-may further comprise a gold alloy coating disposed on a surface of the hard coating.

It is preferred that the gold alloy coating be constituted of an alloy of gold and at least one metal selected from the group consisting of Al, Si, V, Cr, Ti, Fe, Co, Ni, Cu, Zn, Ge, Y, Zr, Nb, Mo, Ru, Rh, Pd, Ag, Cd, In, Sn, Hf, Ta, W, Ir and Pt.

The decorative item is, for example, an exterior part of the timepiece.

The process for producing a decorative item according to the present invention comprises the steps of:

providing a base material of stainless steel having a hardened layer extending from a surface thereof to an arbitrary depth wherein a solute atom is diffused so as to form a solid solution; and forming at least one hard coating on a surface of the hardened layer of the base material.

This process enables obtaining the above decorative item of the present invention, for example, an exterior part of timepiece such as a wristwatch band.

One form of an exterior part of a timepiece according to the present invention comprises a stainless steel having at its surface a carburized layer wherein carbon is diffused therein so as to form a solid solution (namely, the exterior part of the timepiece comprising a base material of stainless steel provided at its surface with a carburized layer), wherein the carburized layer has a polished surface whose Vickers hardness (HV) is 500 or more.

Preferably, the polished surface is specular.

Another form of exterior part of timepiece according to the present invention comprises a stainless steel having at its surface a carburized layer wherein carbon is diffused therein so as to form a solid solution, wherein the carburized layer has a machined surface.

It is preferred that the machine surface have a Vickers hardness (HV) of 500 or more. This exterior part of the timepiece can be produced by machining a surface of an exterior part of the timepiece and thereafter carburizing the machined surface.

One form of a wristwatch band of the present invention comprises a plurality of band pieces of stainless steel connected to each other, each of the band pieces having at its surface a carburized layer wherein carbon is diffused so as to form a solid solution, wherein the carburized layer has a polished surface whose Vickers hardness (HV) is 500 or more.

Preferably, the polished surface is specular.

Another form of wristwatch band of the present invention comprises a plurality of band pieces of stainless steel connected to each other, each of the band pieces having at its surface a carburized layer wherein carbon is diffused so as to form a solid solution, wherein the carburized layer has a machined surface.

In these wristwatch bands, the band pieces may be connected to each other by means of connecting parts of stainless steel, each of the connecting parts having, as at least a portion of its surface, a carburized layer wherein carbon is diffused so as to form a solid solution.

In the present invention, it is preferred that the wristwatch band be one produced by connecting the band pieces to each other by means of connecting parts, carburizing the band pieces and the connecting parts, and thereafter polishing surfaces of the band pieces.

The wristwatch bands of the present invention may further comprise connecting parts having no carburized layer.

One mode of process for producing a wristwatch band according to the present invention comprises the steps of:

connecting a plurality of band pieces of stainless steel to each other by means of a plurality of connecting parts of stainless steel;

fluorinating the band pieces and the connecting parts in a fluorogas atmosphere at 400 to 500° C.;

gas carburizing the fluorinated band pieces and connecting parts in a carburizing gas atmosphere containing carbon monoxide at 400 to 500° C.;

pickling the carburized band pieces and connecting parts, followed by rinsing; and subjecting surfaces of the band pieces to barrel polishing.

A wristwatch band having machined surfaces can be obtained by machining surfaces of the band pieces connected by means of the connecting parts prior to the fluorination.

Another mode of process for producing a wristwatch band according to the present invention comprises the steps of:

fluorinating a plurality of band pieces of stainless steel and a plurality of connecting parts of stainless steel in a fluorogas atmosphere at 250 to 600° C.;

gas carburizing the fluorinated band pieces and connecting parts in a carburizing gas atmosphere containing carbon monoxide at 400 to 500° C.;

pickling the carburized band pieces and connecting parts, followed by rinsing;

subjecting surfaces of the band pieces to barrel polishing; and connecting the band pieces by means of the connecting parts.

A wristwatch band having machined surfaces can be obtained by machining surfaces of the plurality of band pieces prior to the fluorination.

The process for producing an exterior part of a timepiece other than a wristwatch band according to the present invention comprises the steps of:

connecting a plurality of pieces of stainless steel to each other by means of a plurality of connecting parts of stainless steel to obtain a base material for a timepiece exterior part of stainless steel other than a wristwatch band;

fluorinating the base material in a fluorogas atmosphere at 250 to 600° C.;

gas carburizing the fluorinated base material in a carburizing gas atmosphere containing carbon monoxide at 400 to 500° C.;

pickling the carburized base material, followed by rinsing; and subjecting surfaces of the base material to barrel polishing.

An exterior part of a timepiece other than a wristwatch band having machined surfaces can be obtained by machining surfaces of the base material prior to the fluorination.

It is preferred that the wristwatch band of the present invention be one obtained by the above process for producing a wristwatch band according to the present invention.

It is also preferred that the exterior part of the timepiece other than the wristwatch band according to the present invention be one obtained by the above process for producing an exterior part of the timepiece other than the wristwatch band according to the present invention.

Austenitic stainless steel is preferably employed as the stainless steel for use in the present invention.

A further form of an exterior part of a timepiece according to the present invention comprises a metal, this metal having at its surface a deformed layer containing a fibrous structure wherein metal crystal grains are deformed so as to be fibrous, at least the deformed layer having a hardened layer wherein a solute atom is diffused so as to form a solid solution.

The above deformed layer is generally formed by application of a physical external force to at least the surface of the metal. In the present invention, it is preferred that the deformed layer be formed by application to the metal surface of a physical external force capable of drawing the metal surface substantially unidirectionally.

This deformed layer preferably extends from the metal surface to a depth of 2 to 100 μm.

The above hardened layer preferably extends from a surface of the deformed layer to a depth of 5 to 50 μm.

The above solute atom may be at least one atom selected from the group consisting of carbon, nitrogen and oxygen atoms.

The hardened layer preferably has a specular surface whose Vickers hardness (HV) is 500 or greater.

The process for producing an exterior part of a timepiece constituted of stainless steel according to the present invention comprises the steps of:

applying a physical external force to a surface of stainless steel so as for at least the stainless steel surface to have a deformed layer containing a fibrous structure wherein metal crystal grains are deformed so as to be fibrous; and dissolving a solute atom in a surface of the deformed layer so as to form a solid solution therein, thereby effecting such a hardening that a hardened layer is formed.

It is preferred that the above deformed layer be formed by application to the stainless steel surface of a physical external force capable of drawing the stainless steel surface substantially unidirectionally.

This deformed layer may be formed by subjecting the stainless steel surface to at least one of polishing and grinding operations whereby a physical external force capable of drawing the stainless steel surface substantially unidirectionally is applied to, the stainless steel surface.

In particular, the deformed layer may be formed by subjecting the stainless steel surface to at least one of cutting and grinding operations to form a face of desired shape, and polishing the face of desired shape to form the deformed layer.

Alternatively, the stainless steel surface may be subjected to a grinding operation to form not only a face of desired shape but also the deformed layer.

The face of desired shape may be substantially flat, or may be curved.

It is preferred that the deformed layer be so formed as to extend from the stainless steel surface to a depth of 2 to 100 μm.

The hardened layer is preferably so formed as to extend from a surface of the deformed layer to a depth of 5 to 50 μm.

The above solute atom may be at least one atom selected from the group consisting of carbon, nitrogen and oxygen atoms.

Preferably, the hardened layer has a specular surface whose Vickers hardness (HV) is 500 or greater.

The above deformed layer is generally formed in a surface of stainless steel of a base material for a timepiece exterior part produced by forging capable of realizing a high degree of deformation.

The above hardening is generally carried out at a temperature which is close to the recrystallization temperature of the stainless steel or below. The hardening can be performed at temperature over the recrystallization temperature of the stainless steel. However, under such temperature conditions, the orange peel would not occur to make it unnecessary to form the deformed layer.

Austenitic stainless steel is preferably employed as the stainless steel for use in the present invention.

The terminology "exterior part of timepiece" used herein means, for example, a wristwatch band, bezel, casing, back lid, buckle and dial.

DETAILED DESCRIPTION OF THE INVENTION

Figure 1:
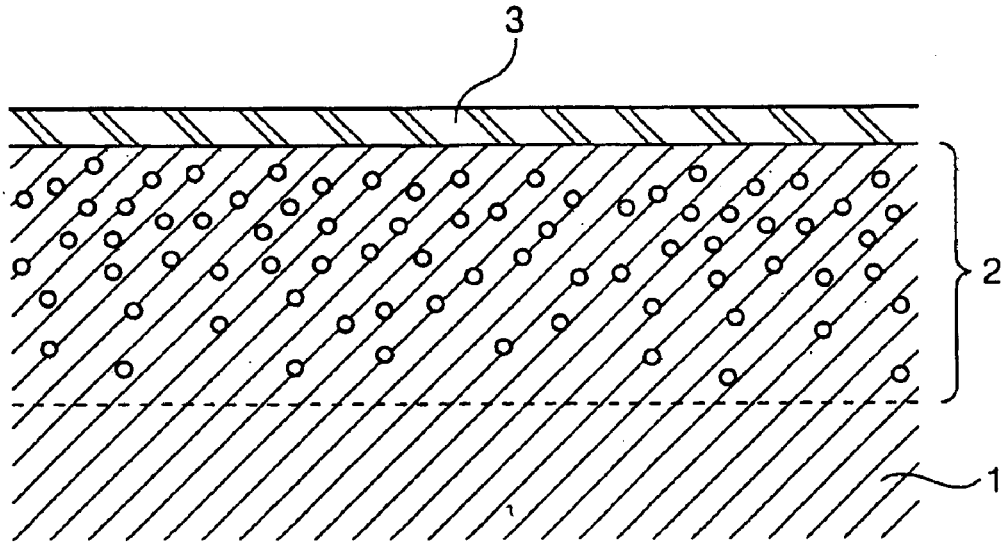
FIG. 1 is a schematic view of the structure of band pieces produced in Example A1 of the present invention.

The decorative item of the present invention and the process for producing the same will first be described below.

The decorative item of the present invention comprises a base material having a hardened layer wherein a solute atom is diffused so as to form a solid solution; and at least one hard coating disposed on a surface of the hardened layer. Optionally, the decorative item may further comprise a gold alloy coating disposed on a surface of the hard coating.

Base Material

The base material for use in the decorative item of the present invention can be, for example, any of stainless steel, titanium metals and titanium alloys.

In particular, austenitic stainless steel is preferably employed as the stainless steel.

The titanium metals refer to metallic materials based mainly on pure titanium, and include, for example, titanium type 1, titanium type 2 and titanium type 3 specified in the Japanese Industrial Standards (JIS).

The titanium alloys refer to metallic materials comprising metals based mainly on pure titanium and, added thereto, aluminum, vanadium, iron or the like. The titanium alloys include, for example, titanium type 60 and titanium type 60E specified in the Japanese Industrial Standards (JIS). Further, the titanium alloys include various other titanium alloys and various titanium-based intermetallic compounds.

In the present invention, a solute atom is diffused in a surface of the above base material constituted of a metal or alloy so as to form a solid solution, thereby providing a hardened layer.

The above solute atom may be at least one atom selected from the group consisting of carbon, nitrogen and oxygen atoms.

Carbon atoms may be diffused in stainless steel, for example, austenitic stainless steel. Alternatively, nitrogen atoms together with oxygen atoms may be diffused in stainless steel.

Nitrogen atoms together with oxygen atoms may be diffused in titanium-or a titanium alloy. Alternatively, carbon atoms may be diffused in titanium or a titanium alloy.

The hardened layer is preferably so formed as to extend from a surface of the base material to a depth of 5 to 50 $\mu$m.

Preferably, the hardened layer has a specular surface whose Vickers hardness (HV; loaded with 50 g) is 500 or greater.

In the present invention, for example, the formation of a carburized layer as the hardened layer in the base material constituted of austenitic stainless steel containing no titanium metals is preferably carried out through the following process.

(1) Fluorination:

Before the formation of a carburized layer, it is preferred that the base material be fluorinated in a fluorogas atmosphere at 100 to 500° C., especially 150 to 300° C.

The above austenitic stainless steel can be, for example, Fe—Cr—Ni—Mo stainless steel or Fe—Cr—Mn stainless steel. Stable stainless steel whose Ni content is minimized is preferably employed as the austenitic stainless steel in the present invention from the viewpoint of depth of carburized hardened layer and cost. From the viewpoint of corrosion resistance, however, stainless steel whose Ni content is high and containing a valence element Mo in an amount of about 1.5 to 4% by weight is preferably employed. As the optimum austenitic stainless steel, there can be mentioned stainless steel obtained by adding 1.5 to 4% by weight of Mo to stable stainless steel whose chromium content is in the range of 15 to 25% by weight and wherein the austenitic phase is stable despite working effected at ordinary temperatures.

The fluorogas for use in the above fluorination can be, for example, a gas of any of fluorocompounds such as $NF_3$, $CF_4$, $SF_4$, $C_2F_6$, $BF_3$, $CHF_3$, HF, $SF_6$, $WF_6$. $SiF_4$ and $ClF_3$. These fluorocompound gases can be used individually or in combination. Also, besides these gases, gases of other compounds containing fluorine in molecules thereof can be used as the above fluorogas. Further, $F_2$ gas formed by thermal cracking of these fluorocompound gases by means of a thermal cracking apparatus or $F_2$ gas otherwise prepared in advance can be used as the above fluorogas. The above fluorocompound gases and $F_2$ gas can be used in an arbitrary combination.

The fluorogases such as the above fluorocompound gases and $F_2$ gas, although they can be used alone, are generally diluted with an inert gas such as nitrogen gas or argon gas before use. The concentration of fluorogas per se in the diluted gas is generally in the range of 10,000 to 100,000 ppm by volume, preferably 20,000 to 70,000 ppm by volume, and still preferably 30,000 to 50,000 ppm by volume.

The fluorogas most favorably employed in the present invention is $NF_3$. The $NF_3$ is gaseous at ordinary temperatures and has high chemical stability, and its handling is easy. The $NF_3$ gas is generally combined with nitrogen gas and used at concentrations which fall within the above range.

The fluorination of the present invention is carried out by disposing, for example, a base material wrought into a given shape in a fluorogas atmosphere of the above concentration at 100 to 500° C. The period of fluorination, although varied depending on the type and size of fluorinated material, etc., is generally in the range of ten-odd minutes to some hours.

This fluorination leads to formation of a fluorinated coating highly permeable for carbon atoms on the surface of the base material. Accordingly, the subsequent gas carburization as hardening operation causes carbon atoms to penetrate and diffuse from the surface of stainless steel to the internal part thereof, so that a carburized hardened layer can be formed easily.

(2) Gas Carburization:

The thus fluorinated base material is gas carburized in a carburizing gas atmosphere containing carbon monoxide at 400 to 500° C., preferably 400 to 480° C.

The carburizing gas for use in this carburization contains carbon monoxide as a carbon source gas. It is generally used in the form of a mixed gas composed of carbon monoxide, hydrogen, carbon dioxide and nitrogen.

In the present invention, by virtue of the gas carburization at low temperatures ranging from 400 to 500° C., crystalline chromium carbide such as $Cr_{23}C_6$ would not precipitate in the carburized hardened layer to avoid consumption of chromium atoms of the austenitic stainless steel. As a result, the carburized hardened layer can maintain excellent corrosion resistance. Further, by virtue of the low carburization temperature, bulking of crystalline chromium carbide such as $Cr_{23}C_6$, $Cr_7C_3$ or $Cr_3C_2$ by the carburization would not occur, and strength lowering due to softening of the internal part of stainless steel would be slight.

As a result of the above gas carburization, the carburized hardened layer (carbon diffusion penetration layer) is uniformly formed at the surface of the basis material constituted of austenitic stainless steel. Furthermore, the above gas carburization would not lead to occurrence of crystalline chromium carbide and to consumption of chromium atoms of the basis material (also referred to as "base material"). As a result, the carburized hardened layer can maintain corrosion resistance that is substantially equal to the excellent corrosion resistance inherently possessed by the austenitic stainless steel.

A layer wherein mainly C and Fe of stainless steel are simultaneously present, probably "mill scale" containing iron oxides such as $Fe_2O_3$, is formed on the surface of basis material after the gas carburization.

(3) Pickling:

After the above gas carburization, the basis material for the decorative item, for example, the base material for the exterior part of the timepiece is pickled. For example, the base material for the exterior part of the timepiece is immersed in an acid solution.

The acid solution for use in this pickling is not particularly limited. For example, it can be a solution of any of hydrofluoric acid, nitric acid, hydrochloric acid, sulfuric acid and ammonium fluoride. These acids can be used alone, and also can be used in the form of a solution of a mixture of ammonium fluoride and nitric acid, a mixture of nitric acid and hydrofluoric acid, a mixture of nitric acid and hydrochloric acid or a mixture of sulfuric acid and nitric acid.

Although the concentration of acid solution can be appropriately determined, with respect to, for example, a solution of a mixture of nitric acid and hydrochloric acid, it is preferred that the nitric acid concentration range from about 15 to 40% by weight and that the hydrochloric acid concentration range from about 5 to 20% by weight. With respect to a nitric acid solution, it is preferred that the concentration thereof range from about 10 to 30% by weight.

The acid solution can be used at both ordinary temperatures and high temperatures.

For the pickling, electrolysis may be performed with the use of an electrolytic solution such as nitric acid or sulfuric acid.

The immersion time in the acid solution, although depending on the type of acid solution, is generally in the range of about 15 to 90 min.

By virtue of this pickling, the iron contained in the mill scale formed on the surface of the base material for exterior part of timepiece, attributed to the carburization, is oxidized and diffused away to attain removal of the mill scale. However, only this pickling cannot accomplish complete removal of the mill scale. Further, the surface of hardened layer formed by the gas carburization is roughened by the dissolution of iron caused by the immersion in the acid solution.

(4) Rinsing:

After the above pickling, the basis material for the decorative item, for example, the base material for the exterior part of the timepiece is rinsed (washed).

By virtue of this rinsing, not only is any mill scale being peeled from the base material for the exterior part of the timepiece washed away but also the acid solution attaching to the base material for the exterior part of the timepiece is completely washed away so as to stop the advance of the roughening of the carburized hardened layer by the acid solution. Despite the above pickling and rinsing, the mill scale cannot be completely removed from the surface of the base material for the exterior part of the timepiece.

(5) Polishing:

After the rinsing, the surface of the basis material for the decorative item, for example, the base material for the exterior part of the timepiece is subjected to barrel polishing.

For example, the base material for the exterior part of the timepiece is set inside a barrel vessel of a barrel polishing machine. Preferably, walnut chips and alumina abrasive as polishing mediums are placed in the barrel vessel. Barrel polishing is carried out for a period of about 10 hr to polish the rough surface formed at the outermost surface of the carburized hardened layer as well as the remaining mill scale.

The mill scale formed on the surface of the base material for the exterior part the timepiece can be completely removed by the combination of the above pickling, rinsing and barrel polishing. Even if the base material for the exterior part of the timepiece has a complex configuration, the mill scale can be completely removed therefrom. Further, the base material for the exterior part of the timepiece can be polished by the barrel polishing so as to have a specular surface.

When buffing is carried out in place of the barrel polishing, it is extremely difficult to completely remove the mill scale formed on the surface of the base material for the exterior part of the timepiece.

If the surface hardness (HV) of the carburized layer after the barrel polishing is at least 500 as measured under a load of 50 g, it is satisfactory as that of the exterior part of the timepiece and other decorative items. It is preferred that the surface hardness (HV) be at least 600 as measured under a load of 50 g.

In the present invention, after the barrel polishing, the surface of the basis material for the decorative item such as the base material for the exterior part of the timepiece may further be buffed.

After the buffing, if the surface hardness (HV) of the carburized layer is at least 500 as measured under a load of 50 g, it is satisfactory as that of the exterior part of the timepiece and other decorative items. It is preferred that the surface hardness (HV) be at least 600 as measured under a load of 50 g.

Hard Coating

It is preferred that the hard coating as a constituent of the decorative item of the present invention be constituted of a nitride, carbide, oxide, nitrido-carbide or nitrido-carbido-oxide of an element belonging to Group 4a, 5a or 6a of the periodic table. In particular, a hard coating of carbon is especially preferred.

An intermediate layer can be disposed between this hard coating of carbon and a surface of the hardened layer of the basis material.

It is preferred that the intermediate layer comprise a lower layer of Ti or Cr disposed on the hardened layer surface of the basis material and an upper layer of Si or Ge disposed on a surface of the lower layer.

In the decorative item of the present invention, at least two hard coatings may be formed on the hardened layer surface of the basis material, or at least two hard coatings may be laminated on the hardened layer surface of the basis material.

Further, in the decorative item of the present invention, the hard coating may be disposed on a portion of the hardened layer surface of the basis material.

The hard coating as a constituent of the decorative item of the present invention may be one exhibiting a tone which is different from that of the surface of the basis material.

The surface hardness of the hard coating is generally greater than that of the basis material.

Specific methods of forming the above hard coating and specific methods of forming the intermediate layer disposed between the hard coating of carbon and the surface of the hardened layer of basis material will be described later with reference to Example A's.

Gold Alloy Coating

The decorative item of the present invention may further comprise a gold alloy coating disposed on the hard coating.

It is preferred that the gold alloy coating be constituted of, for example, an alloy of gold and at least one metal selected from the group consisting of Al, Si, V, Cr, Ti, Fe, Co, Ni, Cu, Zn, Ge, Y, Zr, Nb, Mo, Ru, Rh, Pd, Ag, Cd, In, Sn, Hf, Ta, W, Ir and Pt.

Specific methods of forming the above gold alloy coating will be described later with reference to Example A's.

Now, the exterior part of the timepiece according to the present invention and the process for producing the same will be described in detail.

The exterior part of a timepiece according to the present invention can be classified into a wristwatch band as obtained by connecting a plurality of band pieces of stainless steel to each other by means of a plurality of connecting parts of stainless steel and an exterior part of a timepiece other than the wristwatch band.

With respect to the band pieces and connecting parts constituting the former wristwatch band, at least the band pieces are carburized, preferably gas carburized, so that a carburized hardened layer is formed at the surface thereof.

The latter exterior part of the timepiece other than the wristwatch band is also carburized, preferably gas carburized, so that a carburized hardened layer is formed at the surface thereof.

In the production of the wristwatch band comprising a plurality of band pieces connected to each other by means of a plurality of connecting parts, not only the band pieces but also the connecting parts (connecting pins, length adjustment pins, etc.) are carburized, so that a hard carburized layer is formed in the connecting parts in a region extending from the surface thereof to a depth of tens of microns ($\mu$m). As a result, the hardness of the connecting parts is increased, so that, even if the band is stretched along the length thereof, the connecting parts, such as connecting pins and length adjustment pins, are resistant to bend or breakage. Therefore, even if extremely large external force is applied to the wristwatch band, accidental disconnection of band pieces is rare. Thus, the strength of the band comprising a large number of band pieces connected to each other is high.

Upon the formation of the carburized hardened layer, it may occur that the elastic force of length adjustment pins is changed, and hence that detaching of the length adjustment pins becomes difficult, or contrarily easy. In such an instance, after the barrel polishing step and further buffing step, it is preferred to replace the carburized length adjustment pins by noncarburized length adjustment pins.

In the above expression "with respect to the band pieces and connecting parts constituting the former wristwatch band, at least the band pieces are carburized, preferably gas carburized, so that a carburized hardened layer is formed at the surface thereof", the terminology "at least the band pieces" means that, after the barrel polishing step and further buffing step, the carburized length adjustment pins may be replaced by noncarburized length adjustment pins.

In the wristwatch band comprising a plurality of band pieces of stainless steel connected to each other by means of a plurality of connecting parts of stainless steel according to the present invention, not only the band pieces but also the connecting parts are carburized, preferably gas carburized, before or after the connection of a plurality of band pieces by means of a plurality of connecting parts.

It is especially preferred that the stainless steel for use as the material of the wristwatch band or constituent parts thereof (band pieces or connecting parts) be austenitic stainless steel. The stainless steel for use in the present invention does not contain titanium metals.

The above austenitic stainless steel is a stainless steel whose at least 60% by weight has an austenite phase at ordinary temperatures. For example, there can be mentioned an Fe—Cr—Ni—Mo stainless steel or an Fe—Cr—Mn stainless steel. As the austenitic stainless steel for use in the present inventions, while a stable stainless steel whose Ni content is minimized is preferred from the viewpoint of depth of carburized hardened layer and cost, a stainless steel having a high Ni content and containing Mo being a valence element in an amount of about 1.5 to 4% by weight is preferred from the viewpoint of corrosion resistance. As the most suitable austenitic stainless steel, there can be mentioned one obtained by adding 1.5 to 4% by weight of Mo to a stable stainless steel having a chromium content of 15 to 25% by weight wherein the austenite phase is stable even if processed at ordinary temperatures.

Machining

In the present invention, the surface of the base materials for band pieces connected to each other by means of connecting parts, or band pieces prior to connection, or personal ornaments, can be machined prior to the fluorination in order to obtain exterior parts of timepiece with surfaces having been subjected to machining, such as hairline finishing wherein a vast plurality of mutually parallel nicks are engraved or honing wherein a vast plurality of recessed portions are cut.

With respect to the surface of the base materials for band pieces connected to each other by means of connecting parts, or band pieces prior to connection, or personal ornaments, the carburized hardened layer formed in the surface by gas carburizing is so hard that machining thereof is extremely difficult. The machining is performed prior to the fluorination because of working convenience.

The depth of hairline, honing recessed portions or the like, engraved by the above machining in the surface of the base materials for band pieces or exterior parts of timepiece other than the wristwatch band, is naturally to be such that hairline or honing patterns appear even after barrel polishing and further buffing described later. In the machining, the depth of hairline, honing recessed portions or the like, although not particularly limited, is generally in the range of about 5 to 7 $\mu$m. After the barrel polishing and further buffing, the depth of hairline, honing recessed portions or the like is generally in the range of about 1 to 2 $\mu$m.

Moreover, in the present invention, the above machining can be performed on the surface having been polished by the barrel polishing and further buffing described later so as to be specular. With respect to the carburized layer, the concentration of carbon of solid solution is lowered in accordance with the increase of the depth from the surface thereof, so that the hardness of the layer is decreased. Therefore, removing the region to about 1–2 $\mu$m from the extremely hard surface of carburized hardened layer by the barrel polishing and further buffing leads to slight lowering of the surface hardness of the carburized hardened layer. The resultant polished surface can be machined.

This machining is not performed when the surface of the base materials for band pieces connected to each other by means of connecting parts, or band pieces prior to connection or exterior parts of timepiece other than the wristwatch band, is rendered specular.

For causing both the specular surface and the machined surface to be simultaneously present, conventional methods can be employed. For example, first masking portions to be rendered specular, subsequently machining and thereafter removing the mask enables machining only the nonmasked portions while the masked portions are specular.

With respect to the surface hardness (HV) of the carburized layer having undergone the above machining, 500 or greater under a load of 50 g is satisfactory as the hardness of the exterior parts of the timepiece. It is preferred that the surface hardness be 600 or greater under a load of 50 g.

Fluorination

In the wristwatch band comprising a plurality of band pieces of stainless steel connected to each other by means of a plurality of connecting parts of stainless steel according to the present invention, not only the band pieces but also the connecting parts are fluorinated by heating them in a fluorogas atmosphere at 250 to 600° C., preferably 300 to 500° C., before or after the connection of a plurality of band pieces of stainless steel by means of a plurality of connecting parts of stainless steel.

Also, in the exterior parts of the timepiece other than the wristwatch band comprising band pieces connected to each other by means of connecting pails, the base material thereof (base material for exterior parts of timepiece) is fluorinated by heating it in a fluorogas atmosphere at 250 to 600° C., preferably 300 to 500° C.

Fluorogases are employed in the fluorination.

Examples of fluorogases employed in this fluorination, examples of preferred fluorogases, the fluorogas concentration in the use thereof and the method of application thereof are the same as described hereinbefore with respect to the decorative item of the present invention and the process for producing the same.

In the present invention, this fluorination is carried out, for example, by placing, after shaping into given morphology, stainless steel band pieces and connecting parts for the wristwatch band, or wristwatch bezels, casings, back lids, dials, etc., in a fluorination furnace and heating them in a fluorogas atmosphere of the aforementioned concentration at 250 to 600° C. The fluorination time, although depending on the type and size of materials to be fluorinated, is generally in the range of ten-odd-minutes to tens of minutes.

As a result of this fluorination, the passive coating containing-$Cr_2O_3$ formed at the surface of materials to be fluorinated is converted to a fluorinated coating. This fluorinated coating exhibits high penetrability for carbon atoms. Therefore, in the subsequent gas carburizing, carbon atoms are penetrated and diffused from the surface of stainless steel toward the internal part thereof, thereby enabling easily forming the carburized hardened layer.

Gas Carburizing

The thus fluorinated base materials for band pieces, connecting parts or other exterior parts of wristwatch are gas carburized at 400 to 500° C., preferably 400 to 480° C., in a carburizing gas atmosphere containing carbon monoxide.

In the carburizing gas for use in this carburization, carbon monoxide is used as a carbon source gas. The carburizing gas is generally applied in the form of a mixed gas consisting of carbon monoxide and any of hydrogen, carbon dioxide and nitrogen.

The carburization capability (carbon potential: Pc value) of the carburizing gas is generally expressed by the formula:

$$Pc=(Pco)^2/Pco_2$$

wherein Pco and $Pco_2$ represent the partial pressure of CO and partial pressure of $CO_2$ in the gas atmosphere, respectively.

In accordance with the increase of this Pc value, the carburization capability is enhanced, and the surface carbon concentration of stainless steel, for example, austenitic stainless steel is increased to increase the surface hardness, but the amount of soot formed in the gas carburization furnace is also increased. However, even if the Pc value is set over a given limiting point, there is a limit in the surface hardness of resultant carburized hardened layer. On the other hand, in accordance with the decrease of the Pc value, the carburization capability is diminished and the surface carbon concentration of austenitic stainless steel is lowered to result in lowering of the surface hardness.

In the present invention, by lowering the gas carburization temperature to 400 to 500° C., precipitation of crystalline chromium carbide such as $Cr_{23}C_6$ in the carburized hardened layer and hence consumption of chromium atoms in the austenitic stainless steel can be avoided to enable maintaining the excellent corrosion resistance of the carburized hardened layer. Further, because of the low carburization temperature, not only can bulky enlargement of chromium carbides by the carburization be avoided but also the strength lowering by softening of the internal part of stainless steel is slight.

By virtue of this gas carburization, the carburized hardened layer (layer wherein carbon is diffused and penetrated) is homogeneously formed at the surface of the base materials for austenitic stainless steel band pieces and connecting parts thereof, or other austenitic stainless steel exterior parts of timepiece.

None of crystalline chromium carbides such as $Cr_{23}C_6$, $Cr_7C_3$ and $Cr_3C_2$, is formed in the above carburized hardened layer, and only ultrafine metal carbides with a particle diameter of 0.1 $\mu$m or less are recognized by an observation through a transmission electron microscope. As a result of spectral analysis with the use of a transmission electron microscope, it is found that the ultrafine metal carbides have the same chemical composition as that of the base material and are not crystalline chromium carbides. In the carburized hardened layer, carbon atoms are penetrated and diffused in the metal lattice of the base material and do not form chromium carbides. The carburized hardened layer consists of the same austenitic phase as that of the base material. Because of the penetration and dissolution of a large amount of carbon atoms, the carburized hardened layer suffers a conspicuous lattice strain. By virtue of a combined effect attained by the ultrafine metal carbides and the lattice strain, a hardness enhancement of the carburized hardened layer is realized. Thus, a Vickers hardness (HV) as high as 700 to 1050 can be attained. Furthermore, because the above gas carburizing does not lead to formation of crystalline chromium carbides and to consumption of chromium atoms in the base material, the carburized hardened layer has the same level of excellent corrosion resistance as that inherently possessed by the austenitic stainless steel.

An extremely thin mill scale is formed on the gas carburized surface of the base materials for band pieces and connecting parts thereof, or other exterior parts of timepiece.

Pickling

The base materials for band pieces and connecting parts thereof, or other exterior parts of the timepiece, after the above gas carburizing, are pickled in the same manner as described hereinbefore with respect to the decorative item of the present invention and the process for producing the same. For example, the base materials for band pieces and connecting parts thereof, or other exterior parts of the timepiece are immersed in an acid solution.

Iron contained in the mill scale, which has been formed on the surface of the base materials for band pieces and connecting parts thereof, or other exterior parts of timepiece as a result of the carburizing, is oxidized and diffused in the acid solution by the pickling. Thus, the mill scale is removed. However, the mill scale cannot be completely removed by the pickling only. Moreover, the surface of band pieces, etc., namely the surface of the carburized hardened layer formed by the gas carburizing, is roughened because of the dissolution of iron caused by the immersion in the acid solution.

Rinsing

After the above pickling, the base materials for band pieces and connecting parts thereof, or other exterior parts of timepiece, are rinsed.

This rinsing enables not only washing away any mill scale being peeled from the base materials for band pieces and connecting parts thereof, or other exterior parts of timepiece, but also completely washing away the acid solution sticking to the base materials for band pieces and connecting parts thereof, or other exterior parts of timepiece, so as to avoid further advance of roughening of the carburized hardened layer by the acid solution. However, the mill scale formed on the surface of the base materials for band pieces and connecting parts thereof, or other exterior parts of timepiece, cannot be completely removed by the above pickling and rinsing.

Barrel Polishing

The rinsed surface of the base materials for band pieces and connecting parts thereof, or other exterior parts of timepiece, is subjected to barrel polishing.

For example, the base materials for the wristwatch band obtained by connecting band pieces to each other by means of connecting parts, or band pieces and connecting parts prior to connection, or other exterior parts of timepiece, are disposed inside a barrel vessel of a barrel polishing apparatus. Polishing mediums, preferably walnut chips and alumina abrasive, are placed in the barrel vessel. A barrel polishing is performed over a period of about 10 hr, thereby removing rough faces formed on the outermost surface of the carburized hardened layer of band pieces, etc. and also the mill scale remaining on the outermost surface.

The mill scale formed on the surface of the base materials for mutually connected band pieces, unconnected band pieces, connecting parts to be employed for connecting band pieces to each other, or other exterior parts of timepiece, can be completely removed by sequentially carrying out the pickling, the rinsing and the barrel polishing. Even if the base materials for these exterior parts of timepiece have complex configuration, the mill scale can be completely removed. When the machining such as hairline finishing is not effected, the surface of the base materials for mutually connected band pieces, unconnected band pieces, connecting parts to be employed for connecting band pieces to each other, or other exterior parts of timepiece, can be rendered specular by this barrel polishing.

In the event that buffing is performed in place of the barrel polishing, it is very difficult to completely remove the mill scale formed on the surface of the base materials for mutually connected band pieces, unconnected band pieces, connecting parts to be employed for connecting band pieces to each other, or other exterior parts of timepiece.

With respect to the surface hardness (HV) of the carburized layer having undergone the above barrel polishing, 500 or greater under a load of 50 g is satisfactory as the hardness of exterior parts of timepiece. It is preferred that the surface hardness be 600 or greater under a load of 50 g.

Buffing

After the barrel polishing, the surface of the base materials for band pieces, mutually connected band pieces, or other exterior parts of timepiece, may further be buffed.

With respect to the surface hardness (HV) of the carburized layer having undergone the above buffing, 500 or greater under a load of 50 g is satisfactory as the hardness of exterior parts of timepiece. It is preferred that the surface hardness be 600 or greater under a load of 50 g.

Connection of a Plurality of Band Pieces

Unconnected band pieces are connected to each other by means of connecting parts to thereby obtain a completed wristwatch band.

Another form of exterior part of timepiece according to the present invention and the process for producing the same will be described in detail below.

First, another form of exterior part of timepiece according to the present invention will be described.

Another Form of Exterior Part of Timepiece

Another form of exterior part of timepiece according to the present invention comprises a metal, this metal having at its surface a deformed layer containing a fibrous structure wherein metal crystal grains are deformed so as to be fibrous, at least the deformed layer having a hardened layer wherein a solute atom is diffused so as to form a solid solution.

The metal for constituting this exterior part of timepiece can be, for example, any of stainless steel, titanium metals and titanium alloys. In particular, stainless steel, especially austenitic stainless steel, is preferably employed as the above metal.

The above deformed layer is a layer provided at a metal surface and containing a fibrous structure wherein metal crystal grains are deformed so as to be fibrous. For forming the fibrous structure wherein metal crystal grains are deformed so as to be fibrous, it is needed to apply a physical external force to at least surface of the metal. It is preferred that the deformed layer be formed by application to the metal surface of a physical external force capable of drawing the metal surface substantially unidirectionally.

As means for applying the physical external force to the metal surface, there can be mentioned polishing or grinding.

As the polishing, there can be mentioned, for example, customary buffing or burnishing.

In the present invention, the metal surface can be sequentially burnished and buffed. Also, prior to the buffing or burnishing of the metal surface, the metal surface can be subjected to barrel polishing. Further, grinding or cutting can be performed on the metal surface prior to the buffing or burnishing of the metal surface.

It is preferred that the deformed layer extend from the metal surface to a depth of 2 to 100 $\mu$m.

In the present invention, a hardened layer wherein a solute atom is diffused so as to form a solid solution is formed at the surface of the above deformed layer, so that, after the formation of the hardened layer as well, the metal crystal grains are fibrous. As a result, no height difference occurs between crystal grains and crystal grain boundaries to disenable viewing any orange peels by the naked eye. Therefore, exterior parts of timepiece having a smooth or specular surface can be obtained. This smooth or specular surface may be planar, or curved.

It is preferred that the hardened layer extend from a surface of the deformed layer to a depth of 5 to 50 $\mu$m.

The solute atom is at least one atom selected from the group consisting of carbon, nitrogen and oxygen atoms.

The specular surface of the hardened layer preferably exhibits a Vickers hardness (HV) of 500 or greater.

Process for Producing Another Form of Exterior Part of Timepiece

Formation of Deformed Layer

In the above other form of exterior part of timepiece according to the present invention, a physical external force is applied to a surface of stainless steel so as for at least the stainless steel surface to have a deformed layer containing a fibrous structure wherein metal crystal grains are deformed so as to be fibrous.

This deformed layer is preferably formed by application to the stainless steel surface of a physical external force capable of drawing the stainless steel surface substantially unidirectionally.

As means for applying the physical external force to the metal surface, there can be mentioned polishing or grinding.

As the polishing, there can be mentioned, for example, customary buffing or burnishing.

In this burnishing, the base material for an exterior part of timepiece is fixed on the circumferential surface of a rotary wheel so that the upper surface of the base material is arranged outwards. Subsequently, the rotary wheel is rotated, and diamond or an ultrahard tool (for example, tungsten or carbide) is pressed to the upper surface of the base material to polish the upper surface of the base material.

In the present invention, the metal surface can be sequentially burnished and buffed. Also, prior to the buffing or burnishing of the metal surface, the metal surface can be subjected to barrel polishing. Further, grinding or cutting can be performed on the metal surface prior to the buffing or burnishing of the metal surface.

In this grinding, the upper surface of the base material for an exterior part of timepiece is pressed to a grinding wheel (emery wheel) being rotated so that the upper surface of the base material for an exterior part of timepiece is ground by abrasive grains of the grinding wheel. In the present invention, grinding is performed with a grinding power moderated. The method of moderating the grinding power, for example, comprises using less coarse abrasive grains in the grinding wheel, or reducing the number of such abrasive grains, or reducing the amount of grinding agent.

In the present invention, the deformed layer can be formed by subjecting the stainless steel surface to at least one of cutting and grinding operations to form a face of desired shape, and polishing the face of desired shape to form the deformed layer. Alternatively, not only a face of desired shape but also the deformed layer can be formed by grinding the stainless steel surface.

The face of desired shape may be substantially flat, or curved.

With respect to the individual means for applying a physical external force, the order of preference is:

burnishing>buffing>grinding>cutting.

In the present invention, it is especially preferred to employ grinding and buffing in combination.

It is preferred that the deformed layer be so formed as to extend from the stainless steel surface to a depth of 2 to 100 $\mu$m.

In the present invention, the above deformed layer is generally formed at the surface of stainless steel as the base material for an exterior part of timepiece, produced by forging (cold forging or hot forging) ensuring a large extent of deformation.

Formation of Hardened Layer

Now, a hardened layer is formed by subjecting the surface of the thus formed deformed layer to such a hardening that a solute atom is diffused in the surface of the deformed layer so as to form a solid solution therein.

At least one atom selected from the group consisting of carbon, nitrogen and oxygen atoms is used as the above solute atom. For example, carbon atoms are diffused in the austenitic stainless steel, or nitrogen and oxygen atoms are diffused in titanium or a titanium alloy. Alternatively, carbon atoms are diffused in titanium or a titanium alloy.

The hardened layer is preferably so formed as to extend from the surface of the deformed layer to a depth of 5 to 50 $\mu$m.

Preferably, the hardened layer has a specular surface whose Vickers hardness (HV) is 500 or greater.

In the present invention, for example, when a carburized layer as the hardened layer is formed on the surface of the deformed layer obtained in the above manner in the basis material for an exterior part of the timepiece, constituted of austenitic stainless steel containing no titanium metals, an exterior part of the timepiece is preferably produced through the following process.

Specifically, in this process, it is preferred that, before the formation of a carburized layer, the basis material for an exterior part of timepiece having the deformed layer provided at the surface thereof be fluorinated in a fluorogas atmosphere at 100 to 500° C., especially 150 to 300° C.

The above austenitic stainless steel can be, for example, Fe—Cr—Ni—Mo stainless steel or Fe—Cr—Mn stainless steel. Stable stainless steel whose Ni content is minimized is preferably employed as the austenitic stainless steel in the present invention from the viewpoint of depth of carburized hardened layer and cost. From the viewpoint of corrosion resistance, however, stainless steel whose Ni content is high and containing a valence element Mo in an amount of about 1.5 to 4% by weight is preferably employed. As the optimum austenitic stainless steel, there can be mentioned stainless steel obtained by adding 1.5 to 4% by weight of Mo to stable stainless steel whose chromium content is in the range of 15 to 25% by weight and wherein the austenitic phase is stable despite working effected at ordinary temperatures.

Examples of fluorogases employed in this fluorination, examples of preferred fluorogases, the fluorogas concentration in the use thereof and the method of application thereof are the same as described hereinbefore with respect to the decorative item of the present invention and the process for producing the same.

In the present invention, this fluorination is carried out, for example, by placing, after shaping into given morphology, stainless steel band pieces for the wristwatch band, or wristwatch bezels, casings, back lids, dials, etc., in a fluorination furnace and heating them in a fluorogas atmosphere of the aforementioned concentration at 100 to 500° C. The fluorination time, although depending on the type and size of materials to be fluorinated, is generally in the range of ten-odd minutes to some hours.

This fluorination leads to formation of a fluorinated coating highly permeable for carbon atoms on the surface of the deformed layer. Accordingly, the subsequent gas carburization as hardening operation causes carbon atoms to penetrate and diffuse from the surface of stainless steel to the internal part thereof, so that a carburized hardened layer can be formed easily.

The thus fluorinated base material for an exterior part of timepiece is gas carburized in the same manner as described above with respect to the exterior part of timepiece (including wristwatch band) of the present invention and the process for producing the same. That is, the fluorinated base material is gas carburized in a carburizing gas atmosphere containing carbon monoxide at 400 to 500° C., preferably 400 to 480° C.

In the present invention, by virtue of the gas carburization at low temperatures ranging from 400 to 500° C., crystalline chromium carbide such as $Cr_{23}C_6$ would not precipitate in the carburized hardened layer to avoid consumption of chromium atoms of the austenitic stainless steel. As a result, the carburized hardened layer can maintain excellent corrosion resistance. Further, by virtue of the low carburization temperature, bulking of chromium carbides by the carburization would not occur, and strength lowering due to softening of the internal part of stainless steel would be slight.

By virtue of this gas carburization, the carburized hardened layer (layer wherein carbon is diffused and penetrated) is homogeneously formed at the surface of the austenitic stainless steel base materials for exterior parts of timepiece.

None of crystalline chromium carbides such as $Cr_{23}C_6$, $Cr_7C_3$ and $Cr_3C_2$, is formed in the above carburized hardened layer, and only ultrafine metal carbides with a particle diameter of 0.1 $\mu$m or less are recognized by an observation through a transmission electron microscope. As a result of spectral analysis with the use of a transmission electron microscope, it is found that the ultrafine metal carbides have the same chemical composition as that of the base material and are not crystalline chromium carbides. In the carburized hardened layer, carbon atoms are penetrated and diffused in the metal lattice of the base material and do not form chromium carbides. The carburized hardened layer consists of the same austenitic phase as that of the base material. Because of the penetration and dissolution of a large amount of carbon atoms, the carburized hardened layer suffers a conspicuous lattice strain. By virtue of a combined effect attained by the ultrafine metal carbides and the lattice strain, a hardness enhancement of the carburized hardened layer is realized. Thus, a Vickers hardness (HV) as high as 700 to 1050 can be attained. Furthermore, because the above gas carburizing does not lead to formation of crystalline chromium carbides and to consumption of chromium atoms in the base material, the carburized hardened layer has the same level of excellent corrosion resistance as that inherently possessed by the austenitic stainless steel.

An extremely thin mill scale is formed on the gas carburized surface of the base materials for exterior parts of timepiece.

The thus gas carburized base materials for exterior parts of timepiece are pickled in the same manner as described hereinbefore with respect to the decorative item of the present invention and the process for producing the same.

Iron contained in the mill scale, which has been formed on the surface of the base materials for exterior parts of timepiece as a result of the carburizing, is oxidized and diffused by this pickling. Thus, the mill scale is removed. However, the mill scale cannot be completely removed by the pickling only. Moreover, the surface of the carburized hardened layer formed by the gas carburizing is roughened because of the dissolution of iron caused by the immersion in an acid solution.

After the above pickling, the base materials for exterior parts of timepiece are rinsed.

This rinsing enables not only washing away any mill scale being peeled from the base materials for exterior parts of timepiece, but also completely washing away the acid solution sticking to the base materials for exterior parts of timepiece, so as to avoid further advance of roughening of the carburized hardened layer by the acid solution. However, the mill scale formed on the surface of the base materials for exterior parts of timepiece cannot be completely removed by the above pickling and rinsing.

The surface of the base materials for exterior parts of timepiece after the rinsing is subjected to barrel polishing.

For example, the base materials for exterior parts of timepiece are disposed inside a barrel vessel of a barrel polishing apparatus. Polishing mediums, preferably walnut chips and alumina abrasive, are placed in the barrel vessel. A barrel polishing is performed over a period of about 10 hr, thereby removing rough faces formed on the outermost surface of the carburized hardened layer and also the mill scale remaining on the outermost surface.

The mill scale formed on the surface of the base materials for exterior parts of timepiece can be completely removed by sequentially carrying out the pickling, the rinsing and the barrel polishing. Even if the base materials for exterior parts of timepiece have complex configuration, the mill scale can be completely removed. Further, the surface of the base materials for exterior parts of timepiece can be rendered specular by this barrel polishing.

In the event that buffing is performed in place of the barrel polishing, it is very difficult to completely remove the mill scale formed on the surface of the base materials for exterior parts of timepiece.

With respect to the surface hardness (HV) of the carburized layer having undergone the above barrel polishing, 500 or greater under a load of 50 g is satisfactory as the hardness of exterior parts of timepiece. It is preferred that the surface hardness be 600 or greater under a load of 50 g.

In the present invention, after the barrel polishing, the surface of the base materials for exterior parts of timepiece may further be buffed.

With respect to the surface hardness (HV) of the carburized layer having undergone the above buffing, 500 or greater under a load of 50 g is satisfactory as the hardness of exterior parts of timepiece. It is preferred that the surface hardness be 600 or greater under a load of 50 g.

The decorative item of the present invention comprises a basis material having a hardened layer extending from a surface thereof to an arbitrary depth wherein a solute atom is diffused so as to form a solid solution; and at least one hard coating disposed on a surface of the hardened layer of the basis material. By virtue of this structure, the decorative item has an enhanced surface hardness and hence is excellent in scratch resistance.

Further, the decorative item of the present invention can have a gold alloy coating superimposed on an entire surface or part of surface of the above hard coating. Therefore, the decorative item can exhibit golden color or other various tones without detriment to the surface hardness to have enhanced ornamental value.

The process for producing a decorative item according to the invention enables obtaining the above decorative item, such as an exterior part of timepiece, according to the present invention with high productivity.

Moreover, according to the present invention, there can be provided an exterior part of timepiece (including a wristwatch band) of stainless steel, especially austenitic stainless steel, which is excellent in scratch resistance and has a specular surface without detriment to the excellent corrosion resistance inherently possessed by austenitic stainless steel; an exterior part of timepiece (including a wristwatch band) of stainless steel, especially austenitic stainless steel, which is excellent in scratch resistance and has a surface subjected to machining, such as hairline finishing or honing, without detriment to the excellent corrosion resistance inherently possessed by austenitic stainless steel; and processes for producing these exterior parts of timepiece.

Another form of the exterior part of the timepiece according to the present invention comprises a metal as a base material therefor, the metal having at its surface a deformed layer containing a fibrous structure wherein metal crystal grains are deformed so as to be fibrous, at least the deformed layer having a hardened layer wherein a solute atom is diffused so as to form a solid solution. By virtue of this structure, the exterior part of the timepiece has a smooth or specular surface free of "orange peel" and is thus exce3llent in appearance.

The process for producing another form of exterior part of timepiece according to the present invention enables providing the above other form of exterior part of timepiece with excellent appearance according to the present invention.

EXAMPLE

The present invention will be further illustrated below with reference to the following Examples, which in no way limit the scope of the invention.

[Examples Relating to the Decorative Item of the Present Invention and the Process for Producing the Same].

Example A1

A base material of austenitic stainless steel SUS 316 was shaped by hot forging, cold forging, cutting and drilling and the like into wristwatch band pieces.

A plurality of band pieces were rotatably connected to each other by inserting connecting parts in pinholes provided by drilling in each of the band pieces. The surface of the thus connected band pieces was buffed or otherwise polished so as to become specular. Thus, wristwatch bands were completed.

In each wristwatch band comprising a large number of band pieces connected to each other, some of the band pieces are those wherein each is separable from neighboring band pieces so as to enable regulating the band length in conformity with the size of the wrist of the wearer, i.e., band pieces for length regulation. The band pieces other than the length regulation band pieces are those which are connected to each other so that each is not easily separable from neighboring band pieces.

As the connecting parts, use was made of connecting parts for connecting length regulation band pieces to each other (length regulation pins) and connecting parts for connecting other band pieces to each other (connecting pins, split pipes and knurled pins).

The wristwatch bands were placed in a metallic muffle furnace and heated. The temperature was raised to 480° C., and a fluorogas (mixed gas consisting of 5% by volume of $NF_2$ and 95% by volume of $N_2$) was blown into the muffle furnace for 15 min. Thus, the wristwatch bands were fluorinated.

The fluorogas was discharged from the muffle furnace. While blowing a carburizing gas (mixed gas consisting of 10% by volume of CO, 20% by volume of $H_2$, 1% by volume of $CO_2$ and 69% by volume of $N_2$), the wristwatch bands were held in the muffle furnace at 480° C. for 12 hr, thereby carburizing the wristwatch bands. The wristwatch bands were taken out from the muffle furnace.

Formation of mill scale was observed on the surface of the wristwatch bands having been carburized and taken out.

The wristwatch bands were immersed in an acid aqueous solution containing 3 to 5% by volume of ammonium fluoride and 2 to 3% by volume of nitric acid for 20 min.

As a result of this pickling, iron contained in the mill scale formed on the surface of band pieces was oxidized and diffused, so that most of the mill scale was removed. Further, no mill scale was observed on interfaces of mutually neighboring band pieces, pinhole inside walls, and connecting parts for connecting band pieces to each other, in particular, connecting pins, split pipes and length regulation pins.

However, the surface of band pieces, namely the surface of the carburized layer formed by the carburization, was roughened by the dissolution of iron caused by the immersion in the acid aqueous solution.

The pickled wristwatch bands were rinsed.

The rinsed wristwatch bands were disposed inside a barrel vessel of a barrel polishing apparatus. Walnut chips and alumina abrasive as polishing mediums were placed in the barrel vessel. A barrel polishing was performed over a period of about 10 hr, thereby removing rough faces formed on the outermost surface of the carburized layer of band pieces. As a result of this barrel polishing, a region of the carburized layer extending from the surface thereof to a depth of 1 to 2 $\mu$m was removed, and the surface of band pieces, namely the outermost surface of the carburized layer, became specular.

The wristwatch bands with a specular surface, obtained by the above processing, was excellent in scratch resistance and maintained the same excellent corrosion resistance as inherently possessed by SUS 316. The surface hardness (HV) of the carburized layer reached 700 under a load of 50 g.

In the above process, because a large number of band pieces were collected and formed into each wristwatch band before being subjected to the fluorination, gas carburizing, pickling, rinsing and barrel polishing, handling of the band pieces was easy to realize a high productivity. Labor and time consumed in the processing were reduced, thereby enabling lowering processing cost.

The connecting parts were also carburized so that a hard carburized layer was formed in a region of each of the connecting parts extending from the surface thereof to a depth of tens of microns ($\mu$m). As a result, the hardness of the connecting parts was increased, so that bending or breakage of connecting pins and length regulation pins was seldom, even when the wristwatch band was stretched along the length thereof.

However, the connecting parts such as connecting pins and length regulation pins remain held in the pinholes provided in band pieces by drilling, so that it is difficult to remove the mill scale formed on the connecting parts by pickling and polishing. In the event that mill scale remains on the connecting parts after the pickling and polishing, it is desirable to replace the connecting parts with mill scale remaining thereon by new connecting parts. This replacement leads to formation of wristwatch bands whose connecting parts only are not furnished with carburized layers.

Among the connecting parts, when mill scale remains on length regulation pins, pulling the length regulation pins out of the band pieces becomes difficult, so that it becomes difficult to regulate the band length in conformity with the size of the wrist of the wearer. In that event, it is desirable to replace only the length regulation connecting parts, among the connecting parts, by new connecting parts. This replacement leads to formation of wristwatch bands whose length regulation connecting parts only are not furnished with carburized layers.

A golden hard coating was formed on the carburized layer of each of the band pieces.

Referring to FIG. 1, TiN coating 3 constituted of titanium nitride, as a golden hard coating, was formed by the ion plating technique being a dry plating technique on carburized layer 2 formed at a surface of band piece 1.

The method of forming the TiN coating 3 will be described below.

Wristwatch band furnished with carburized layer 2 was rinsed with an organic solvent such as isopropyl alcohol and disposed in an ion plating apparatus. Common ion plating apparatus can be employed, so that a description and drawing with respect to the ion plating apparatus will be omitted herein.

The ion plating apparatus was exhausted to $1.0\times10^{-5}$ Torr, and thereafter an argon gas as an inert gas was introduced therein up to $3.0\times10^{-3}$ Torr.

A thermionic filament and a plasma electrode disposed inside the ion plating apparatus were operated to produce argon plasma. Simultaneously, a voltage of −50 V was applied to the wristwatch band, and a bombardment cleaning of the wristwatch band was performed for 10 min.

The introduction of argon gas was discontinued, and a nitrogen gas was introduced in the ion plating apparatus up to $2.0\times10^{-3}$ Torr.

Subsequently, plasma was produced by means of an electron gun disposed inside the ion plating apparatus. In the plasma, titanium was evaporated for 10 min, so that 0.5 $\mu$m thick TiN coating 3 was formed on an entire surface of the wristwatch band, i.e., the carburized layer 2 of the band pieces 1.

Because the TiN coating 3 had the same optical characteristics as gold, the thus obtained wristwatch bands exhibited homogeneous golden tone. This enabled enhancing the ornamental value of the wristwatch bands.

The surface hardness (HV) of the band pieces 1 covered with the TiN coating 3 reached 800 under a load of 50 g. The band pieces 1 covered with the TiN coating 3 had excellent resistances to wear, corrosion and scratch.

The scratch resistance of the band pieces 1 having undergone surface hardening (carburization) was increased by the above formation of the TiN coating 3 which was harder than the carburized layer 2.

The dry plating method is not limited to the above ion plating technique, and use can be made of common means such as the sputtering technique or vacuum evaporation coating (vacuum deposition) technique.

The golden hard coating formed by the dry plating method can be constituted of a nitride, carbide, oxide, nitrido-carbide or nitrido-carbido-oxide of any of the elements of Groups 4a, 5a and 6a of the periodic table (Ti, Zr, Hf, V, Nb, Ta, Cr, Mo and W).

When M represents an element of Group 4a, 5a or 6a of the periodic table and a nitride of M is represented by MNx, the smaller than 1 the value of x representing the degree of nitriding, the closer to light yellow the golden tone of the coating of the nitride MNx. On the other hand, the greater than 1 the value of x representing the degree of nitriding, the more reddish the golden color of the coating. When the value of x representing the degree of nitriding is in the range of 0.9 to 1.1, a golden color close to the tone of gold or a gold alloy can be realized by the coating of the nitride MNx. In particular, when the value of x representing the degree of nitriding satisfies x=1, the coating of the nitride MNx is not only a hard coating with satisfactory hardness but also exhibits a golden color most close to the tone of gold or a gold alloy.

With respect to the carbide, oxide, nitrido-carbide or nitrido-carbido-oxide of element M of Group 4a, 5a or 6a of the periodic table as well, the coating thereof can be endowed with a golden color most close to the tone of gold or a gold alloy by controlling the degree of carbonization, oxidation or nitriding so as to fall within a given range.

The TiN coating and a ZrN coating are especially preferred because these are not only hard coatings with satisfactory hardness but also exhibit a golden color most close to the tone of gold or a gold alloy.

When the thickness of the coating of the nitride MNx is extremely small, the coating cannot have effective resistances to wear, corrosion and scratch. On the other hand, when the thickness is extremely large, the time required for coating formation is prolonged to unfavorably increase coating cost. Accordingly, the thickness of the coating of the nitride MNx is preferably controlled so as to fall within the range of 0.1 to 10 μm, still preferably 0.2 to 5 μm.

Example A2

A hard coating with a tone different from that of Example A1 was formed on the band pieces furnished with carburized layers in the same manner as in Example A1.

Figure 2:
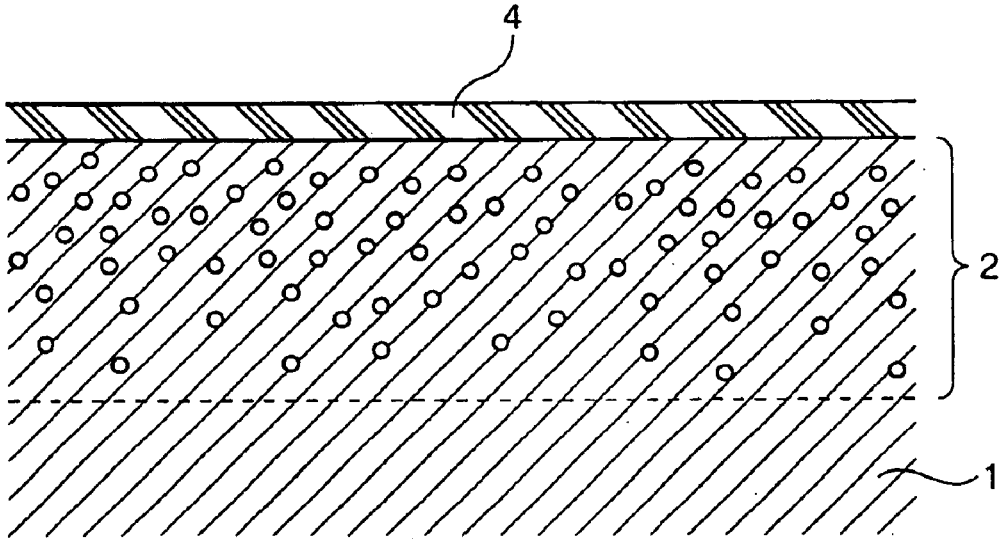
FIG. 2 is a schematic view of the structure of band pieces produced in Example A2 of the present invention.

Referring to FIG. 2, TiC coating 4 constituted of titanium carbide, as a hard coating with white tone, was formed by a dry plating technique on carburized layer 2 formed at a surface of band piece 1.

According to the ion plating technique being a dry plating technique, titanium was evaporated in an ethylene gas atmosphere, and TiC coating 4 was formed on a surface of band piece 1. Other coating conditions were the same as in Example A1.

The thus obtained wristwatch bands, by virtue of the formation of TiC coating 4, exhibited homogeneous white tone. This enabled enhancing the ornamental value of the wristwatch bands.

The surface hardness (HV) of the band pieces 1 covered with the TiC coating 4 reached 800 under a load of 50 g. The band pieces. 1 covered with the TiC coating 4 had excellent resistances to wear, corrosion and scratch.

The scratch resistance of the band pieces 1 having undergone surface hardening (carburization) was increased by the above formation of the TiC coating 4 which was harder than the carburized layer 2.

Example A3

A carbon hard coating as a hard coating with black tone was formed on the band pieces furnished with carburized layers in the same manner as in Example A1. The carbon hard coating, because of having excellent characteristics similar to those of diamond, is widely known as diamondlike carbon (DLC).

Figure 3:
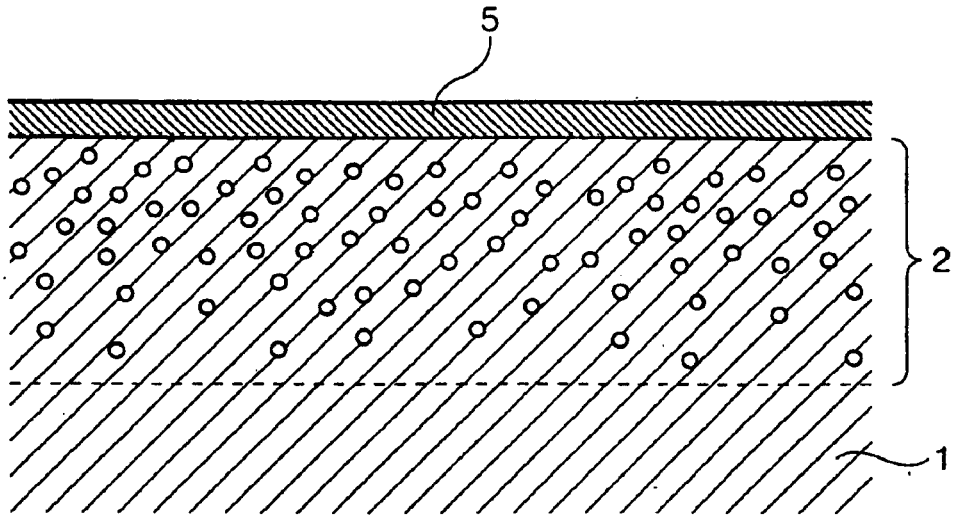
FIG. 3 is a schematic view of the structure of band pieces produced in Example A3 of the present invention.

Referring to FIG. 3, black carbon hard coating 5 was formed by a dry plating technique on carburized layer 2 formed at a surface of band piece 1.

The method of forming the carbon hard coating 5 was, for example, as follows.

First, wristwatch band furnished with carburized layer 2 was rinsed with an organic solvent such as isopropyl alcohol and disposed in a vacuum apparatus. According to the radio-frequency plasma CVD technique, 2 μm thick carbon hard coating 5 was formed on the carburized layer 2 under the following conditions:

[Coating Conditions]
gas species: methane gas,
coating pressure: 0.1 Torr,
high-frequency power: 300 watt, and
coating rate: 0.1 μm per minute.

As a result, the carbon hard coating 5 was formed on the carburized layer 2 with high adherence therebetween.

The thus obtained wristwatch bands, by virtue of the formation of carbon hard coating 5, exhibited homogeneous black tone. This enabled enhancing the ornamental value of the wristwatch bands.

The surface hardness (HV) of the band pieces 1 covered with the carbon hard coating 5 reached 3000 to 5000. The scratch resistance of the band pieces 1 having undergone surface hardening (carburization) was increased by the above formation of the carbon hard coating 5 which was harder than the carburized layer 2.

The thickness of the carbon hard coating 5 was preferably controlled so as to fall within the range of 0.0.1 to 5 μm, still preferably 0.5 to 3 μm.

The formation of carbon hard coating 5 can be accomplished by, besides the above RFP-CVD technique, various gas-phase coating methods such as the DC plasma CVD technique and the ECR technique. Alternatively, physical evaporation coating methods such as the ion beam technique, the sputtering technique and the ion plating technique may be employed.

Figure 4:
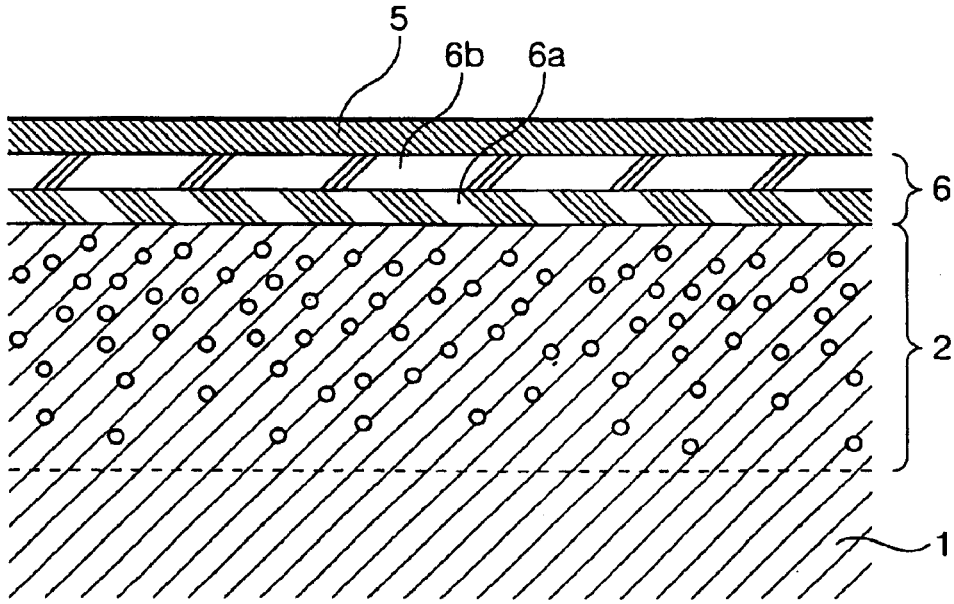
FIG. 4 is a schematic view of the structure of band pieces produced in Example A3 of the present invention.

Moreover, referring to FIG. 4, it is preferred to provide intermediate layer coating 6 between the carburized layer 2 and the carbon hard coating 5, because the adherence of the carbon hard coating 5 to the surface of the band piece 1 is increased.

The method of forming the intermediate layer coating 6 was, for example, as follows.

Ti coating **6*a* with a thickness of 0.1 μm was formed on the carburized layer 2 by a dry plating method, for example, the sputtering technique. Further, Si coating 6*b* with a thickness of 0.3 μm was formed on the Ti coating 6*a*** by the sputtering technique.

Thereafter the carbon hard coating 5 with a thickness of 2 μm was formed on the Si coating **6*b*** by, for example, the radio-frequency plasma CVD technique under the aforementioned conditions.

The above Ti coating **6*a* can be replaced by a chromium (Cr) coating. The above Si coating 6*b*** can be replaced by a germanium (Ge) coating.

The intermediate layer (coating) may be constituted of a single layer of a carbide of Group IVa or Va metal, in place of the above laminate coating. In particular, a coating of a titanium carbide containing excess carbon is preferred from the viewpoint of a high adherence strength to the carbon hard coating.

Example A4

A hard coating with golden tone was formed on part of a surface of each of the band pieces furnished with carburized layers in the same manner as in Example A1.

Figure 7:
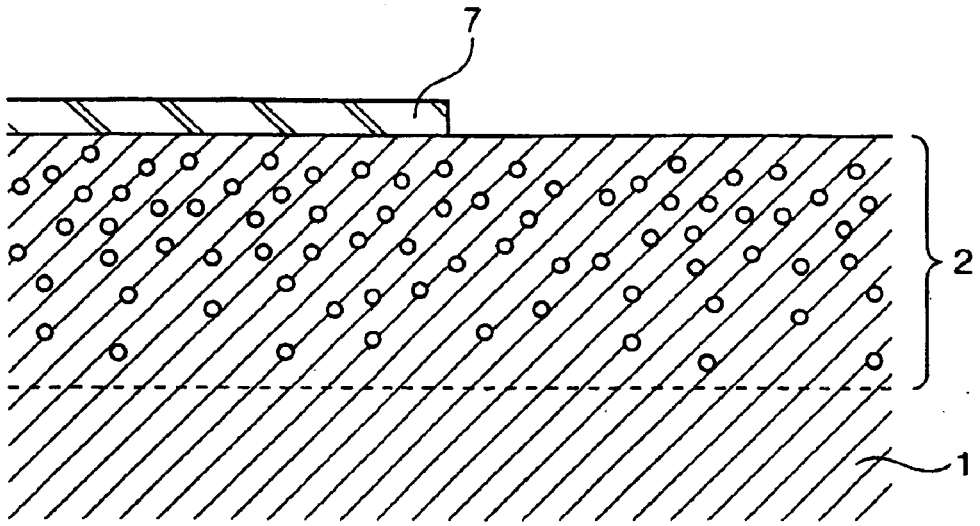
FIG. 7 is a schematic view of the structure of band pieces produced in Example A5 of the present invention.

Referring to FIG. 7, TiN coating 7 constituted of titanium nitride, as a hard coating with golden tone, was formed by the ion plating technique being a dry plating technique on part of a surface of band piece 1.

The method of forming the golden TiN coating 7 on a part of surface will be described below.

Figure 5:
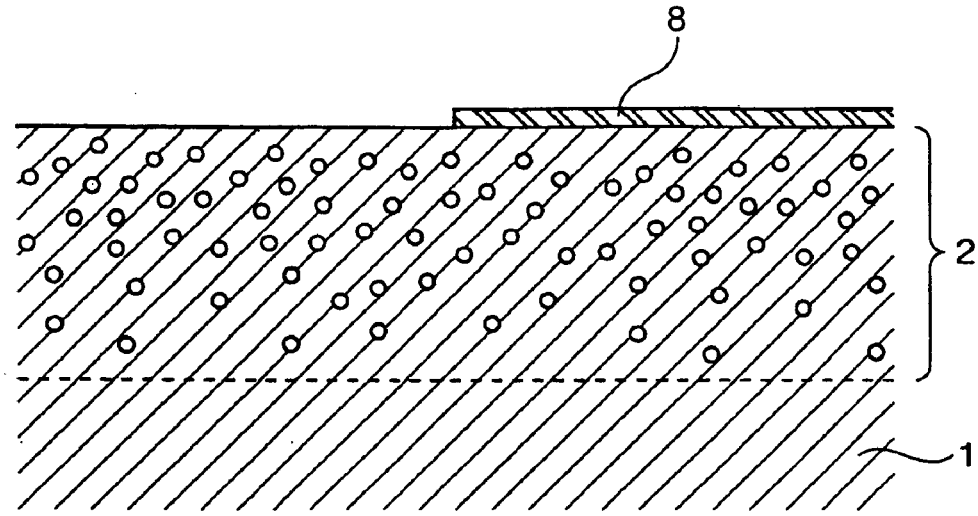
FIG. 5 is a schematic view showing a surface treatment for band pieces carried out in Example A4 of the present invention.

First, referring to FIG. 5, desired part of each of respective surfaces of band pieces 1 furnished with carburized layers 2 was printed with an organic masking agent, or masking ink, of epoxy resin to form masking layer 8.

Subsequently, the band pieces 1 having the masking layer 8 formed thereon were rinsed with an organic solvent such as isopropyl alcohol and disposed in an ion plating apparatus.

Common ion plating apparatus can be employed, so that a description and drawing with respect to the ion plating apparatus will be omitted herein.

The ion plating apparatus was exhausted to $1.0\times10^{-5}$ Torr, and thereafter an argon gas as an inert gas was introduced therein up to $3.0\times10^{-3}$ Torr. Then, a thermionic filament and a plasma electrode disposed inside the ion plating apparatus were operated to produce argon plasma. Simultaneously, a voltage of −50 V was applied to each of the band pieces 1, and a bombardment cleaning thereof was performed for 10 min.

Figure 6:
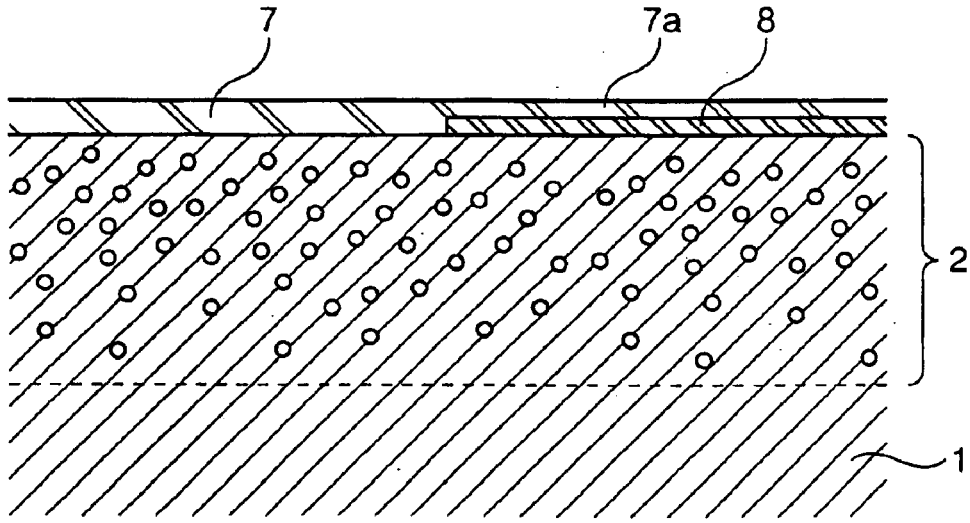
FIG. 6 is a schematic view showing a further surface treatment for of band pieces carried out in Example A4 of the present invention.

The introduction of argon gas was discontinued, and a nitrogen gas was introduced in the ion plating apparatus up to $2.0\times10^{-3}$ Torr. Subsequently, plasma was produced by means of a plasma gun disposed inside the ion plating apparatus. In the plasma, titanium was evaporated for 10 min, so that, referring to FIG. 6, TiN coating 7 was formed on the surface of each of respective hardened layers 2 of band pieces 1 and TiN coating 7*a* on the surface of the masking layer 8, both with a total coating thickness of 0.5 $\mu$m.

The masking layer 8 was swelled with the use of ethyl methyl ketone (EMK) or a stripping solution obtained by adding formic acid and hydrogen peroxide to ethyl methyl ketone (EMK), and the masking layer 8 and the TiN coating 7*a* superimposed thereon were stripped off by the liftoff method.

Thus, there were obtained band pieces having parts covered with the TiN coating 7 to exhibit golden tone and parts not covered with any TiN coating to exhibit silvery white of stainless steel, as shown in FIG. 7. This enabled enhancing the ornamental value of the wristwatch bands.

As masking means, use can be made of mechanical masking means in place of the providing of chemical masking layer described in this Example. That is, masking can be accomplished by covering arbitrary parts of band pieces with metallic caps before the formation of titanium nitride (TiN) coating and removing the metallic caps after the formation of titanium nitride coating. When this masking means is employed, no titanium nitride coating is formed on parts of band pieces covered with the metallic caps, while a titanium nitride coating is formed on parts of band pieces not covered with the metallic caps.

In this Example, although the titanium nitride coating was employed as the hard coating formed on parts of surfaces of band pieces 1, the golden hard coating formed by the dry plating method can also be constituted of a nitride, carbide, oxide, nitrido-carbide or nitrido-carbido-oxide of any of the elements of Groups 4a, 5a and 6a of the periodic table, as mentioned in Example A1.

In particular, when the titanium carbide coating employed in Example A2 is formed on parts of surfaces of band pieces 1, there can be obtained band pieces having parts covered with the titanium carbide coating to exhibit white tone and parts not covered with any titanium carbide coating to exhibit silvery white of stainless steel.

Alternatively, when the carbon hard coating employed in Example A3 is formed on parts of surfaces of band pieces 1, there can be obtained band pieces having parts covered with the carbon hard coating to exhibit black tone and parts not covered with any carbon hard coating to exhibit silvery white of stainless steel.

Example A5

A hard coating with golden tone was formed on the surface of band pieces furnished with carburized layers in the same manner as in Example A1. Further, a gold alloy coating was formed on the golden hard coating.

Figure 8:
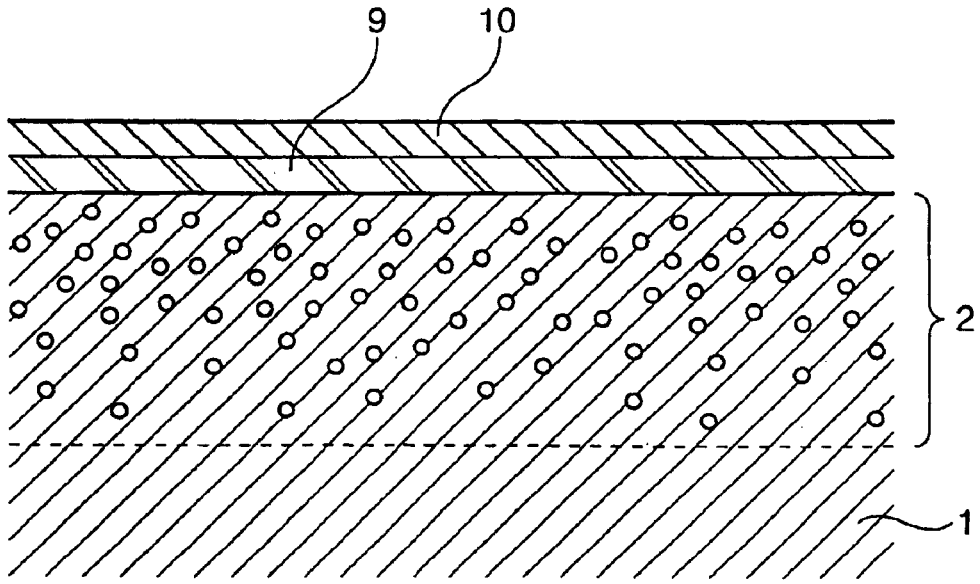
FIG. 8 is a schematic view of the structure of band pieces produced in Example A5 of the present invention.

Referring to FIG. 8, TiN coating 9 constituted of titanium nitride, as a hard coating with golden tone, was formed by the ion plating technique being a dry plating technique on the surface of band piece 1 furnished with carburized layer 2. Gold-titanium alloy coating 10 as a gold alloy coating was formed on the TiN coating 9.

The method of forming the TiN coating 9 and gold-titanium alloy coating 10 of this Example will be described below.

First, bands furnished with carburized layers 2 were rinsed with an organic solvent such as isopropyl alcohol and disposed in an ion plating apparatus. Common ion plating apparatus can be employed, so that a description and drawing with respect to the ion plating apparatus will be omitted herein.

The ion plating apparatus was exhausted to $1.0\times10^{-5}$ Torr, and thereafter an argon gas as an inert gas was introduced therein up to $3.0\times10^{-3}$ Torr.

Then, a thermionic filament and a plasma electrode disposed inside the ion plating apparatus were operated to produce argon plasma. Simultaneously, a voltage of −50 V was applied to each of the band pieces 1, and a bombardment cleaning thereof was performed for 10 min.

Subsequently, plasma was produced by means of a plasma gun disposed inside the ion plating apparatus. In the plasma, titanium was evaporated for 10 min, so that 0.5 $\mu$m thick TiN coating 9 was formed on the entire surface of band pieces 1.

Thereafter, the evaporation of titanium and the introduction of argon gas were discontinued, and the ion plating apparatus was exhausted to $1.0\times10^{-5}$ Torr. An argon gas was introduced in the ion plating apparatus up to $1.0\times10^{-3}$ Torr, and plasma was produced. In the plasma, a gold-titanium mixture consisting of 50 atomic % of gold and 50 atomic % of titanium was evaporated, thereby forming gold-titanium alloy coating 10. When the thickness of gold-titanium alloy coating 10 became 0.3 $\mu$m, the evaporation of the gold-titanium mixture was terminated.

The thus obtained band pieces exhibited homogeneous golden tone. This enabled enhancing the ornamental value of the wristwatch bands. Further, the formation of gold-titanium alloy coating 10 as an outermost layer coating enabled obtaining wristwatch bands which exhibited golden tone having greater warmth than that of the TiN coating 9. This enabled lending enhanced beauty to the wristwatch bands.

Generally, the gold alloy coating per se cannot have effective resistances to wear, corrosion and scratch unless the thickness thereof is greater than 10 $\mu$m. Gold is a very expensive metal. Therefore, increasing the thickness of the gold alloy coating invites an extreme increase of coating cost. However, in this Example, the hard TiN coating was provided under the outermost layer coating constituted of a gold alloy. This TiN coating has excellent resistances to wear, corrosion and scratch, so that the outermost layer coating constituted of a gold alloy can be thinned.

Accordingly, in this Example, there is such an advantage that the usage of expensive gold can be reduced by the sequential formation of TiN coating and thin gold alloy coating, thereby enabling lowering coating cost.

Although the thin formed outermost layer coating constituted of a gold alloy might be partially worn to expose the underlying TiN coating, any partial wearing of the outermost layer coating would never be conspicuous. The reason is that the TiN coating has the same optical characteristics as gold and exhibits golden tone. Even if the outermost layer coating constituted of a gold alloy with golden tone is partially worn, the underlying TiN coating with the same golden tone is exposed there. Therefore, even if the outermost layer coating constituted of a gold alloy is thinned, the wearing is not visible to enable maintaining the beauty of wristwatch bands as a personal ornament and the ornamental value thereof.

In this Example, although the titanium nitride coating was employed as the hard coating, the golden hard coating formed by the dry plating method can also be constituted of a nitride, carbide, oxide, nitrido-carbide or nitrido-carbido-oxide of any of the elements of Groups 4a, 5a and 6a of the periodic table.

The gold alloy coating can be, besides the above gold-titanium alloy coating, a coating constituted of an alloy of gold and at least one metal selected from the group consisting of Al, Si, V, Cr, Fe, Co, Ni, Cu, Zn, Ge, Y, Zr, Nb, Mo, Ru, Rh, Pd, Ag, Cd, In, Sn, Hf, Ta, W, Ir and Pt.

However, when personal ornaments covered with coatings of some gold alloys selected from among the above combinations are brought into contact with the skin, metal ions may be leached by an electrolytic solution such as sweat and have a possibility for causing metal allergy when contacted with human skin equipped with the personal ornaments. In particular, leached nickel ions are known as the metal ion for which the greatest number of metal allergy cases are reported. In contrast, iron is the metal for which the number of metal allergy cases is extremely small. No metal allergy case has been reported with respect to titanium. Therefore, from the viewpoint of metal allergy, it is preferred that the gold alloy coating as the outermost layer coating be constituted of a gold-iron alloy or a gold-titanium alloy.

Example A6

The gold alloy coating described in Example A5 may further be formed only on the hard coating with golden tone partially formed on the surface of band pieces furnished with carburized layers as described in Example A4.

The method of partially forming TiN coating 11 constituted of titanium nitride as a hard coating with golden tone and gold-titanium alloy coating 12 as a gold alloy coating will be briefly described with reference to FIGS. 9 and 10.

Figure 9:
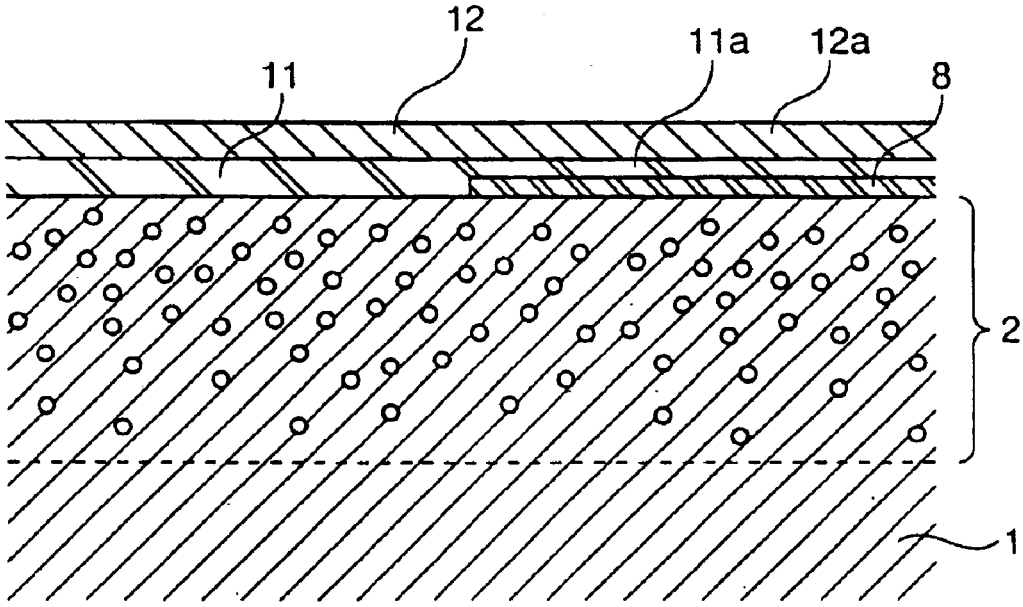
FIG. 9 is a schematic view showing a surface treatment for band pieces carried out in Example A6 of the present invention.

First, referring to FIG. 9, desired part of each of respective surfaces of band pieces 1 furnished with carburized layers 2 was printed with an organic masking agent, or masking ink, of epoxy resin to form masking layer 8.

Subsequently, the band pieces 1 having the masking layer 8 formed thereon were rinsed with an organic solvent such as isopropyl alcohol and disposed in an ion plating apparatus.

According to the ion plating technique being a dry plating technique, TiN coating 11, 11*a* was formed on the surface of carburized layers 2 of band pieces 1 and the surface of the masking layer 8 so that the total coating thickness became 0.5 $\mu$m. Thereafter, 0.3 $\mu$m thick gold-titanium alloy coating 12, 12*a* was formed on the TiN coating 11, 11*a*.

The masking layer 8 was swelled with the use of ethyl methyl ketone (EMK) or a stripping solution obtained by adding formic acid and hydrogen peroxide to ethyl methyl ketone (EMK), and the masking layer 8 and the TiN coating 11*a* and gold-titanium alloy coating 12*a* superimposed thereon were stripped off by the liftoff method.

Figure 10:
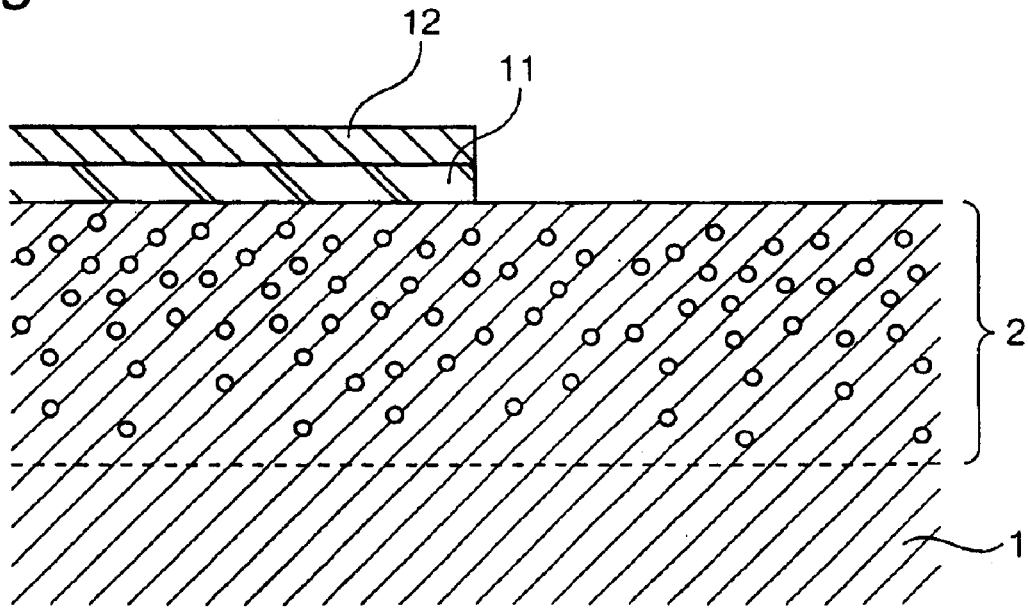
FIG. 10 is a schematic view of the structure of band pieces produced in Example A6 of the present invention.

Thus, there were obtained wristwatch bands having parts covered with the TiN coating 11 and gold-titanium alloy coating 12 to exhibit golden tone and parts not covered with such coatings to exhibit silvery white of stainless steel, as shown in FIG. 10.

In this Example, as mentioned in Example A5, use can be made of various hard coatings other than the titanium nitride coating. Also, use can be made of various gold alloy coatings other than the gold-titanium alloy coating.

Example A7

The first hard coating was formed on the surface of band pieces furnished with carburized layers in the same manner as in Example A1. Further, the second hard coating with tone different from that of the first hard coating was formed on part of the surface of the first hard coating.

Figure 11:
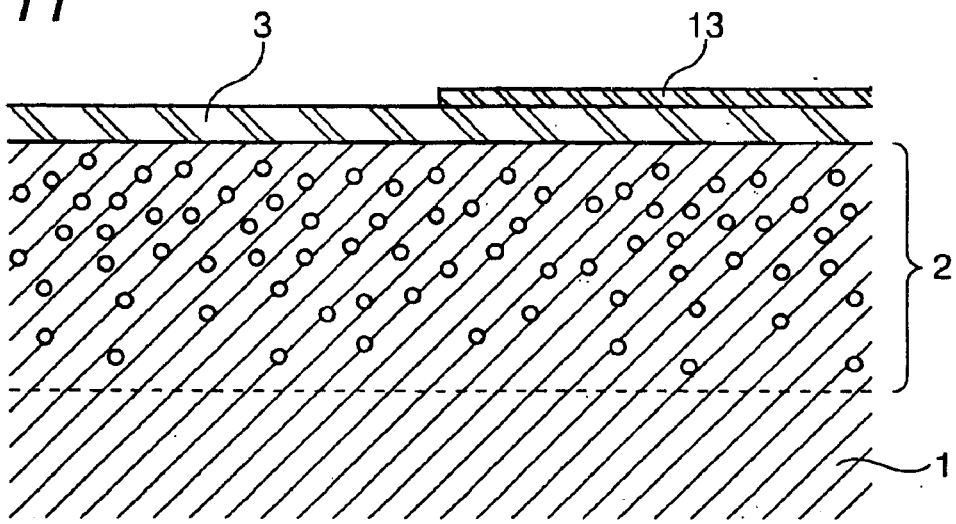
FIG. 11 is a schematic view showing a surface treatment for band pieces carried out in Example A7 of the present invention.

Referring to FIG. 11, golden tone TiN coating 3 constituted of titanium nitride as the first hard coating was formed on the surface of band pieces 1 furnished with carburized layers 2 in the same manner as in Example A1. Masking layer 13 was formed on desired part of the surface of the TiN coating 3 by, for example, printing with an organic masking agent, or masking ink, of epoxy resin.

Figure 12:
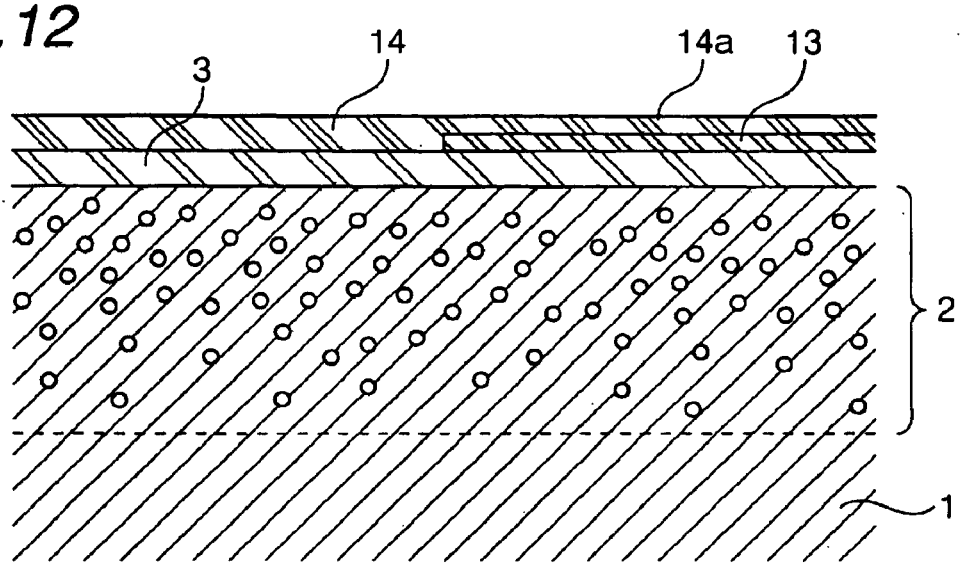
FIG. 12 is a schematic view showing a further surface treatment for band pieces carried out in Example A7 of the present invention.

Subsequently, referring to FIG. 12, white tone TiC coating 14 constituted of titanium carbide as the second hard coating was formed on the surface of the coating 3, and the TiC coating 14*a* on the surface of the masking layer 13, in the same manner as in Example A2.

Thereafter, the masking layer 13 was swelled with the use of a stripping solution, and the masking layer 13 and the TiC coating 14*a* superimposed thereon were stripped off by the liftoff method.

Figure 13:
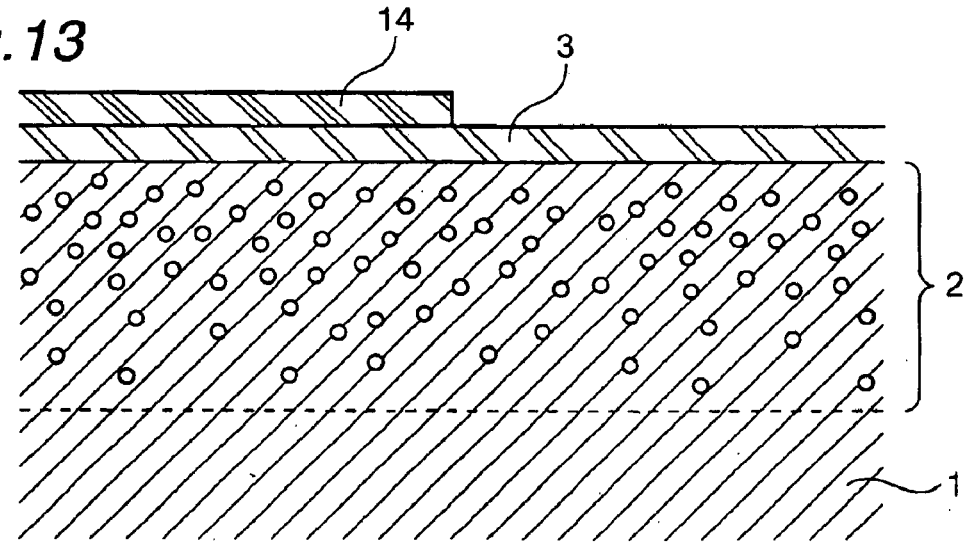
FIG. 13 is a schematic view of the structure of band pieces produced in Example A7 of the present invention.

Thus, there were obtained band pieces having parts exhibiting white tone of the TiC coating 14 superimposed on the surface of golden TiN coating 3 and parts exhibiting golden tone of the TiN coating 3, as shown in FIG. 13. This enabled enhancing the ornamental value of the wristwatch bands. Further, the scratch resistance of the surface-hardened (carburized) band pieces 1 was increased by the superimposition of the TiN coating 3 and TiC coating 14 harder than the carburized layers 2.

In this Example, as in Example A5, use can be made of various hard coatings other than the titanium nitride and titanium carbide coatings. Also, either of the first hard coating and the second hard coating can be replaced by the carbon hard coating of Example A3. The types of masking layer 13 and stripping solution can appropriately be selected in conformity with the type of such coatings.

When M represents an element of Group 4a, 5a or 6a of the periodic table and a nitride of M is represented by MNx, both the first hard coating and the second hard coating can be constituted of MNx. If the first hard coating and the second hard coating are constituted so that the value of x representing the degree of nitriding of the former is different from that of the latter, the tone of the first hard coating can be differentiated from that of the second hard coating. This is true with respect to the carbide, oxide, nitrido-carbide and nitrido-carbido-oxide as well.

Example A8

The first hard coating was formed on part of the surface of band pieces furnished with carburized layers in the same manner as in Example A1. Further, the second hard coating with tone different from that of the first hard coating was formed on the other part of the surface of band pieces.

Figure 14:
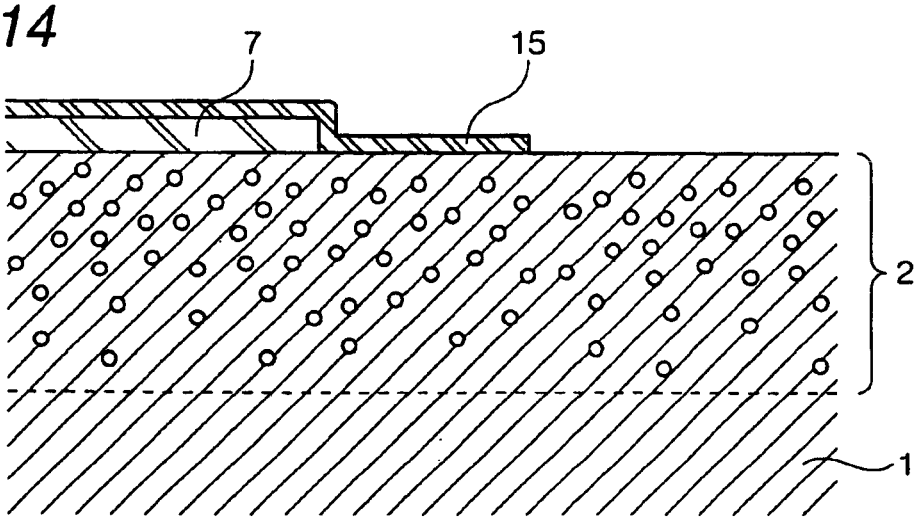
FIG. 14 is a schematic view showing a surface treatment for band pieces carried out in Example A8 of the present invention.

Referring to FIG. 14, golden tone TiN coating 7 constituted of titanium nitride as the first hard coating was formed on part of the surface of band pieces 1 furnished with carburized layers 2 in the same manner as in Example A4. Masking layer 15 was formed on the surface of the TiN coating 7 and desired part of the surface of band pieces 1 continuing therefrom.

Figure 15:
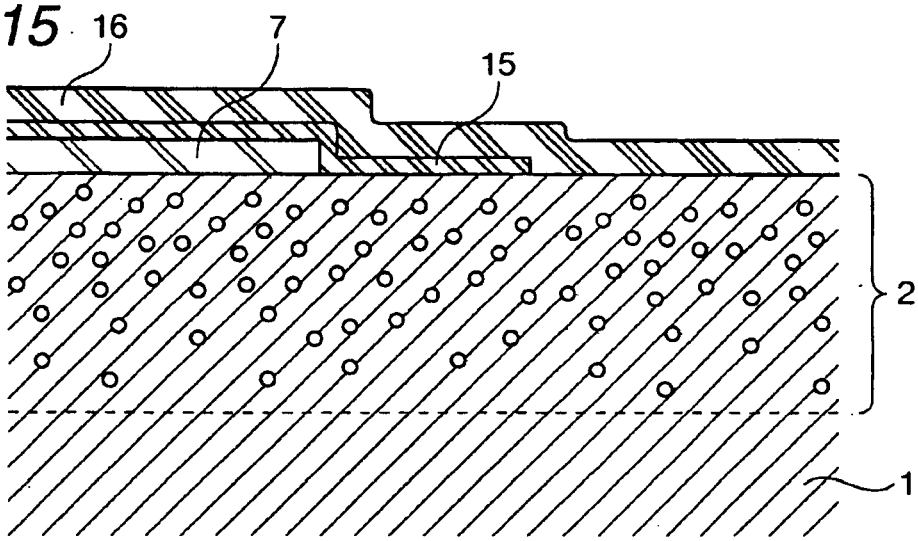
FIG. 15 is a schematic view showing a further surface treatment for band pieces carried out in Example A8 of the present invention.

Subsequently, referring to FIG. 15, white tone TiC coating 16 constituted of titanium carbide as the second hard coating was formed on the TiN coating 7, the masking layer 15 and remaining part of the surface of band pieces 1, in the same manner as in Example A2.

Thereafter, the masking layer 15 was swelled with the use of a stripping solution, and the masking layer 15 and the TiC coating 16 superimposed thereon were stripped off by the liftoff method.

Figure 16:
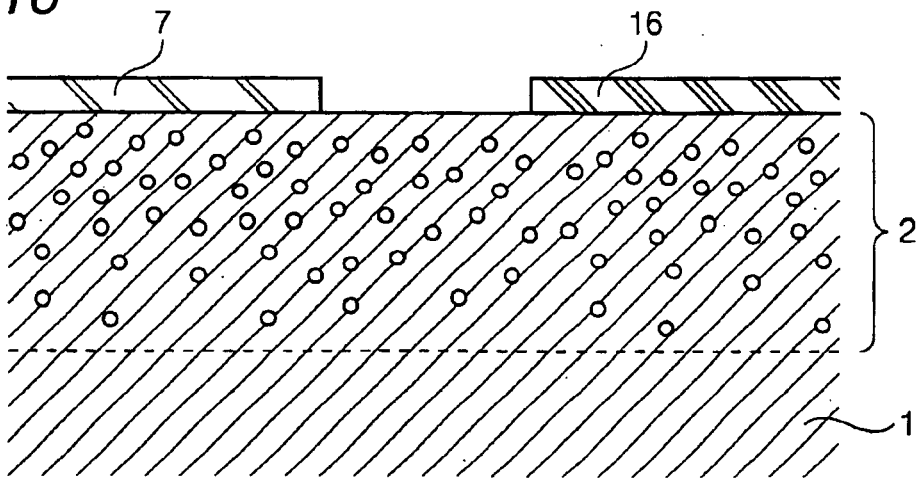
FIG. 16 is a schematic view of the structure of band pieces produced in Example A8 of the present invention.

Thus, there were obtained triple color band pieces having parts covered with the TiN coating 7 to exhibit golden tone, parts covered with the TiC coating 16 to exhibit white tone and parts where the surface of band pieces 1 is exposed, as shown in FIG. 16. This enabled enhancing the ornamental value of the wristwatch bands.

Selection of the first hard coating and second hard coating and selection of the stripping solution and masking layer are the same as described in Example A7. The same gold alloy coating as described in Example A5 may be formed on either or both of the first hard coating and the second hard coating.

Although the ion plating technique was employed as the dry plating method in the above Examples A2 and A4 to A8, use can be made of other common coating forming methods such as the sputtering technique and vacuum evaporation coating technique.

In all the above Examples, the invention was described with reference to hand pieces for wristwatch bands. However, the present invention is also applicable to items for accommodating mechanical or electronic driving mechanism, such as a wristwatch casing. Still further, the present invention is applicable to all other decorative items (including components thereof).

[Examples Relating to the Exterior Part of Timepiece According to the Present Invention and the Process for Producing the Same]

Example B1

A base material of austenitic stainless steel SUS 316 was shaped by hot forging, cold forging, cutting and drilling into wristwatch band pieces.

A plurality of band pieces were rotatably connected to each other by inserting connecting parts in pinholes provided by drilling in each of the band pieces. The surface of the thus connected band pieces was buffed or otherwise polished so as to become specular. Thus, wristwatch bands were completed.

In each wristwatch band comprising a large number of band pieces connected to each other, some of the band pieces are those wherein each is separable from neighboring band pieces so as to enable regulating the band length in conformity with the size of the wrist of the wearer, i.e., band pieces for length regulation. The band pieces other than the length regulation band pieces are those which are connected to each other so that each is not easily separable from neighboring band pieces. As the connecting parts, use was made of connecting parts for connecting length regulation band pieces to each other (length regulation pins) and connecting parts for connecting other band pieces to each other (connecting pins, split pipes and knurled pins).

The wristwatch bands were placed in a metallic muffle furnace and heated. The temperature was raised to 480° C., and a fluorogas (mixed gas consisting of 5% by volume of $NF_2$ and 95% by volume of $N_2$) was blown into the muffle furnace for 15 min. Thus, the wristwatch bands were fluorinated.

The fluorogas was discharged from the muffle furnace. While blowing a carburizing gas (mixed gas consisting of 10% by volume of CO, 20% by volume of $H_2$, 1% by volume of $CO_2$ and 69% by volume of $N_2$), the wristwatch bands were held in the muffle furnace at 480° C. for 12 hr, thereby carburizing the wristwatch bands. The wristwatch bands were removed from the muffle furnace.

Formation of mill scale was observed on the surface of the wristwatch bands having been carburized and taken out.

The wristwatch bands were immersed in an acid aqueous solution containing 3 to 5% by volume of ammonium fluoride and 2 to 3% by volume of nitric acid for 20 min.

As a result of this pickling, iron contained in the mill scale formed on the surface of band pieces was oxidized and diffused, so that most of the mill scale was removed. Further, no mill scale was observed on interfaces of mutually neighboring band pieces, pinhole inside walls, and connecting parts for connecting band pieces to each other, in particular, connecting pins, split pipes and length regulation pins.

However, the surface of band pieces, namely the surface of the carburized layer formed by the carburization, was roughened by the dissolution of iron caused by the immersion in the acid aqueous solution.

The pickled wristwatch bands were rinsed.

The rinsed wristwatch bands were disposed inside a barrel vessel of a barrel polishing apparatus. Walnut chips and alumina abrasive as polishing mediums were placed in the barrel vessel. A barrel polishing was performed over a period of about 10 hr, thereby removing rough faces formed on the outermost surface of the carburized layer of band pieces. As a result of this barrel polishing, a region of the carburized layer extending from the surface thereof to a depth of 1 to 2 $\mu$m was removed, and the surface of band pieces, namely the outermost surface of the carburized layer, became specular.

The wristwatch bands with a specular surface, obtained by the above processing, was excellent in scratch resistance and maintained the same excellent corrosion resistance as inherently possessed by SUS 316. In the above process, because a large number of band pieces were collected and formed into each wristwatch band before being subjected to the above processing steps, labor and time consumed in the processing were reduced, thereby enabling lowering processing cost.

The connecting parts were also carburized so that a hard carburized layer was formed in a region of each of the connecting parts extending from the surface thereof to a depth of tens of microns ($\mu$m). As a result, the hardness of the connecting parts was increased, so that bending or breakage of connecting pins and length regulation pins was rare, even when the wristwatch band was stretched along the length thereof.

In this Example B1, because a large number of band pieces were collected and formed into each wristwatch band before being subjected to the fluorination, gas carburizing, pickling, rinsing and barrel polishing, handling of the band pieces in these processing steps was easy to realize a high productivity.

Example B2

Wristwatch bands were produced in the same manner as in Example B1, except that, before the fluorination, a multiplicity of hairlines were formed along the band length on outer surfaces (when worn round the wrist, surfaces arranged outside) of band pieces.

The resultant wristwatch bands had hairline-finished surfaces, which were excellent in scratch resistance and maintained the same excellent corrosion resistance as inherently possessed by SUS 316.

Example B3

Bezels finished so as to have a specular surface were produced in the same manner as in Example B1, except that the wristwatch bands were replaced by bezels for wristwatch.

The resultant bezels were excellent in scratch resistance and maintained the same excellent corrosion resistance as inherently possessed by SUS 316.

Example B4

Casings finished so as to have a specular surface were produced in the same manner as in Example B1, except that the wristwatch bands were replaced by casings for wristwatch.

The resultant casings were excellent in scratch resistance and maintained the same excellent corrosion resistance as inherently possessed by SUS 316.

Example B5

Back lids finished so as to have a specular surface were produced in the same manner as in Example B1, except that the wristwatch bands were replaced by back lids for wristwatch.

The resultant back lids were excellent in scratch resistance and maintained the same excellent corrosion resistance as inherently possessed by SUS 316.

Example B6

Dials finished so as to have a specular surface were produced in the same manner as in Example B1, except that the wristwatch bands were replaced by dials for wristwatch.

The resultant dials were excellent in scratch resistance and maintained the same excellent corrosion resistance as inherently possessed by SUS 316.

[Examples Relating to the Other Form of Exterior Part of Timepiece According to the Present Invention and the Process for Producing the Same].

Example C1

A rodlike material of austenitic stainless steel SUS 316 was provided. The rodlike material had a rounded rectangular section conforming to the morphology of wristwatch band pieces. The rodlike material was sliced at intervals conforming to band piece widths.

Pinholes for insertion of connecting pins were drilled in the obtained slices, thereby completing band pieces for wristwatch bands.

A plurality of band pieces were rotatably connected to each other by inserting connecting pins in pinholes provided by drilling in each of the band pieces, thereby assembling wristwatch bands.

Upper rounded surface (when worn round the wrist, outer surface arranged outside) of each of the band pieces of wristwatch bands was buffed.

A section of the buffed upper surface portion of band pieces was observed through an electron microscope. As a result, it was recognized that metal crystal grains of the stainless steel surface portion were drawn in the direction of buff rotation by the external force applied by buffing, thereby creating a fibrous structure of metal crystal grains deformed in fibrous form. A deformed layer including this fibrous structure was formed so as to extend from the upper surface of band pieces to a depth of 3 to 7 $\mu$m.

The wristwatch bands were placed in a metallic muffle furnace and heated. The temperature was raised to 480° C., and a fluorogas (mixed gas consisting of 5% by volume of $NF_2$ and 95% by volume of $N_2$) was blown into the muffle furnace for 15 min. Thus, the wristwatch bands were fluorinated.

The fluorogas was discharged from the muffle furnace. While blowing a carburizing gas (mixed gas consisting of 10% by volume of CO, 20% by volume of $H_2$, 1% by volume of $CO_2$ and 69% by volume of $N_2$), the wristwatch bands were held in the muffle furnace at 480° C. for 12 hr, thereby carburizing the wristwatch bands. The wristwatch bands were removed from the muffle furnace.

Formation of mill scale was observed on the surface of the wristwatch bands having been carburized and taken out.

The wristwatch bands were immersed in an acid aqueous solution containing 3 to 5% by volume of ammonium fluoride and 2 to 3% by volume of nitric acid for 20 min.

As a result of this pickling, iron contained in the mill scale formed on the surface of band pieces was oxidized and diffused, so that most of the mill scale was removed. Further, no mill scale was observed on interfaces of mutually neighboring band pieces, pinhole inside walls, and connecting pins for connecting band pieces to each other.

However, the surface of band pieces, namely the surface of the carburized layer formed by the carburization, was roughened by the dissolution of iron caused by the immersion in the acid aqueous solution.

The pickled wristwatch bands were rinsed.

The rinsed wristwatch bands were disposed inside a barrel vessel of a barrel polishing apparatus. Walnut chips and alumina abrasive as polishing mediums were placed in the barrel vessel. A barrel polishing was performed over a period of about 10 hr, thereby removing rough faces formed on the outermost surface of the carburized layer of band pieces.

As a result of this barrel polishing, a region of the carburized layer extending from the surface thereof to a depth of 0.3 to 1 $\mu$m was removed, and the upper surface of band pieces became a smooth beautiful specular surface required for exterior parts of timepiece. On the upper surface, "orange peel" attributed to minute unevenness was not visible at all.

Observation of a section of band pieces after the barrel polishing through an electron microscope showed that the carburized layer was formed so as to extend from the upper surface of band pieces to a depth of 18 to 20 $\mu$m.

Example C2

Cylinders of austenitic stainless steel SUS 316 were provided. The cylinders were cold forged into the configuration of wristwatch band pieces in such a manner that an external force is applied along the central axis passing through the center of a circular section of the cylinders.

Pinholes for insertion of connecting pins were drilled in the thus forged members, thereby completing band pieces for wristwatch bands.

A plurality of band pieces were rotatably connected to each other by inserting connecting pins in pinholes provided by drilling in each of the band pieces, thereby assembling wristwatch bands.

Upper surface (when worn round the wrist, outer surface arranged outside) of each of the band pieces of wristwatch bands was burnished into a planar specular surface. Specifically, each wristwatch band was fixed on the circumferential surface of a rotary wheel so that the upper surface of the wristwatch band was arranged outside. The rotary wheel was rotated, and a diamond tool mounted on the rotary wheel was pressed to the upper surface of the wristwatch band.

A section of the burnished upper surface portion of band pieces was observed through an electron microscope. As a result, it was recognized that metal crystal grains of the stainless steel surface portion were drawn in the direction of rotary wheel rotation by the external force applied by burnishing, thereby creating a fibrous structure of metal crystal grains deformed in fibrous form. A deformed layer including this fibrous structure was formed so as to extend from the upper surface of band pieces to a depth of 5 to 10 $\mu$m.

The wristwatch bands were placed in a metallic muffle furnace and heated. The temperature was raised to 480° C., and a fluorogas (mixed gas consisting of 5% by volume of $NF_2$ and 95% by volume of $N_2$) was blown into the muffle furnace for 15 min. Thus, the wristwatch bands were fluorinated.

The fluorogas was discharged from the muffle furnace. While blowing a carburizing gas (mixed gas consisting of 10% by volume of CO, 20% by volume of $H_2$, 1% by volume of $CO_2$ and 69% by volume of $N_2$), the wristwatch bands were held in the muffle furnace at 480° C. for 12 hr, thereby carburizing the wristwatch bands. The wristwatch bands were removed from the muffle furnace.

Formation of mill scale was observed on the surface of the wristwatch bands having been carburized and taken out.

The wristwatch bands were immersed in an acid aqueous solution containing 3 to 5% by volume of ammonium fluoride and 2 to 3% by volume of nitric acid for 20 min.

As a result of this pickling, iron contained in the mill scale formed on the surface of band pieces was oxidized and diffused, so that most of the mill scale was removed. Further, no mill scale was observed on interfaces of mutually neighboring band pieces, pinhole inside walls, and connecting pins for connecting band pieces to each other.

However, the surface of band pieces, namely the surface of the carburized layer formed by the carburization, was roughened by the dissolution of iron caused by the immersion in the acid aqueous solution.

The pickled wristwatch bands were rinsed.

The rinsed wristwatch bands were disposed inside a barrel vessel of a barrel polishing apparatus. Walnut chips and alumina abrasive as polishing mediums were placed in the barrel vessel. A barrel polishing was performed over a period of about 10 hr, thereby removing rough faces formed on the outermost surface of the carburized layer of band pieces.

As a result of this barrel polishing, a region of the carburized layer extending from the surface thereof to a depth of 0.5 to 1.5 $\mu$m was removed, and the upper surface of band pieces became a smooth beautiful specular surface required for exterior parts of timepiece. On the upper surface, "orange peel" attributed to minute unevenness was not visible at all.

Observation of a section of band pieces after the barrel polishing through an electron microscope showed that the carburized layer was formed so as to extend from the upper surface of band pieces to a depth of 18 to 20 $\mu$m.

Example C3

Wristwatch bands were assembled in the same manner as in Example C2.

Upper surface of each of the band pieces of wristwatch bands was planed by cutting operation and further buffed into a specular surface.

A section of the resultant upper surface portion of band pieces was observed through an electron microscope. As a result, it was recognized that, in the same manner as in Example C1, metal crystal grains of the stainless steel surface portion were drawn in the direction of buff rotation by the external force applied by buffing, thereby creating a fibrous structure of metal crystal grains deformed in fibrous form. A deformed layer including this fibrous structure was formed so as to extend from the upper surface of band pieces to a depth of 3 to 6 $\mu$m.

The wristwatch bands were placed in a metallic muffle furnace and heated. The temperature was raised to 480° C., and a fluorogas (mixed gas consisting of 5% by volume of $NF_2$ and 95% by volume of $N_2$) was blown into the muffle furnace for 15 min. Thus, the wristwatch bands were fluorinated.

The fluorogas was discharged from the muffle furnace. While blowing a carburizing gas (mixed gas consisting of 10% by volume of CO, 20% by volume of $H_2$, 1% by volume of $CO_2$ and 69% by volume of $N_2$), the wristwatch bands were held in the muffle furnace at 480° C. for 12 hr, thereby carburizing the wristwatch bands. The wristwatch bands were removed from the muffle furnace.

Formation of mill scale was observed on the surface of the wristwatch bands having been carburized and taken out.

The wristwatch bands were immersed in an acid aqueous solution containing 3 to 5% by volume of ammonium fluoride and 2 to 3% by volume of nitric acid for 20 min.

As a result of this pickling, iron contained in the mill scale formed on the surface of band pieces was oxidized and diffused, so that most of the mill scale was removed. Further, no mill scale was observed on interfaces of mutually neighboring band pieces, pinhole inside walls, and connecting pins for connecting band pieces to each other.

However, the surface of band pieces, namely the surface of the carburized layer formed by the carburization, was roughened by the dissolution of iron caused by the immersion in the acid aqueous solution.

The pickled wristwatch bands were rinsed.

The rinsed wristwatch bands were disposed inside a barrel vessel of a barrel polishing apparatus. Walnut chips and alumina abrasive as polishing mediums were placed in the barrel vessel. A barrel polishing was performed over a period of about 10 hr, thereby removing rough faces formed on the outermost surface of the carburized layer of band pieces.

As a result of this barrel polishing, a region of the carburized layer extending from the surface thereof to a depth of 1 to 2 $\mu$m was removed, and the upper surface of band pieces became a smooth beautiful specular surface required for exterior parts of timepiece. On the upper surface, "orange peel" attributed to minute unevenness was not visible at all.

Observation of a section of band pieces after the barrel polishing through an electron microscope showed that the carburized layer was formed so as to extend from the upper surface of band pieces to a depth of 20 to 25 μm.

Example C4

Wristwatch bands were assembled in the same manner as in Example C2.

Upper surface of each of the band pieces of wristwatch bands was planed into a specular surface by grinding means with a reduced grinding power. Specifically, the upper surface of wristwatch band was pressed to a grinding (emery) wheel being rotated, so that the upper surface of band pieces was ground by the abrasive grains of the grinding wheel.

The upper surface of band pieces was further buffed so as to obtain a desirable specular surface.

A section of the resultant upper surface portion of band pieces was observed through an electron microscope. As a result, it was recognized that, in the same manner as in Example C1, metal crystal grains of the stainless steel surface portion were drawn in the direction of rotation of grinding wheel and buff by the external force applied by the grinding and buffing, thereby creating a fibrous structure of metal crystal grains deformed in fibrous form. A deformed layer including this fibrous structure was formed so as to extend from the upper surface of band pieces to a depth of 7 to 12 μm.

The wristwatch bands were placed in a metallic muffle furnace and heated. The temperature was raised to 480° C., and a fluorogas (mixed gas consisting of 5% by volume of $NF_2$ and 95% by volume of $N_2$) was blown into the muffle furnace for 15 min. Thus, the wristwatch bands were fluorinated.

The fluorogas was discharged from the muffle furnace. While blowing a carburizing gas (mixed gas consisting of 10% by volume of CO, 20% by volume of $H_2$, 1% by volume of $CO_2$ and 69% by volume of $N_2$), the wristwatch bands were held in the muffle furnace at 480° C. for 12 hr, thereby carburizing the wristwatch bands. The wristwatch bands were removed from the muffle furnace.

Formation of mill scale was observed on the surface of the wristwatch bands having been carburized and taken out.

The wristwatch bands were immersed in an acid aqueous solution containing 3 to 5% by volume of ammonium fluoride and 2 to 3% by volume of nitric acid for 20 min.

As a result of this pickling, iron contained in the mill scale formed on the surface of band pieces was oxidized and diffused, so that most of the mill scale was removed. Further, no mill scale was observed on interfaces of mutually neighboring band pieces, pinhole inside walls, and connecting pins for connecting band pieces to each other.

However, the surface of band pieces, namely the surface of the carburized layer formed by the carburization, was roughened by the dissolution of iron caused by the immersion in the acid aqueous solution.

The pickled wristwatch bands were rinsed.

The rinsed wristwatch bands were disposed inside a barrel vessel of a barrel polishing apparatus. Walnut chips and alumina abrasive as polishing mediums were placed in the barrel vessel. A barrel polishing was performed over a period of about 10 hr, thereby removing rough faces formed on the outermost surface of the carburized layer of band pieces.

As a result of this barrel polishing, a region of the carburized layer extending from the surface thereof to a depth of 1.5 to 2.5 μm was removed, and the upper surface of band pieces became a smooth beautiful specular surface required for exterior parts of timepiece. On the upper surface, "orange peel" attributed to minute unevenness was not visible at all.

Observation of a section of band pieces after the barrel polishing through an electron microscope showed that the carburized layer was formed so as to extend from the upper surface of band pieces to a depth of 15 to 20 μm.

In this Example C4, not only planing of the upper surface of band pieces into a specular surface but also converting of metal crystal grains lying in the vicinity of band piece surface to the fibrous structure can be accomplished by grinding means with a reduced grinding power, thereby enabling reducing the number of production process steps. Therefore, the employment of this grinding enables the lowering of production cost.

Example C5

Wristwatch bands were assembled in the same manner as in Example C2.

Upper surface of each of the band pieces of wristwatch bands was planed into a specular surface by grinding means with a reduced grinding power. Specifically, the upper surface of wristwatch band was pressed to a grinding (emery) wheel being rotated, so that the upper surface of band pieces was ground by the abrasive grains of the grinding wheel.

A section of the resultant upper surface portion of band pieces was observed through an electron microscope. As a result, it was recognized that metal crystal grains of the stainless steel surface portion were drawn in the direction of rotation of grinding wheel with a reduced grinding power, thereby creating a fibrous structure of metal crystal grains deformed in fibrous form. A deformed layer including this fibrous structure was formed so as to extend from the upper surface of band pieces to a depth of 2 to 5 μm.

The wristwatch bands were placed in a metallic muffle furnace and heated. The temperature was raised to 480° C., and a fluorogas (mixed gas consisting of 5% by volume of $NF_2$ and 95% by volume of $N_2$) was blown into the muffle furnace for 15 min. Thus, the wristwatch bands were fluorinated.

The fluorogas was discharged from the muffle furnace. While blowing a carburizing gas (mixed gas consisting of 10% by volume of CO, 20% by volume of $H_2$, 1% by volume of $CO_2$ and 69% by volume of $N_2$), the wristwatch bands were held in the muffle furnace at 480° C. for 12 hr, thereby carburizing the wristwatch bands. The wristwatch bands were removed from the muffle furnace.

Formation of mill scale was observed on the surface of the wristwatch bands having been carburized and taken out.

The wristwatch bands were immersed in an acid aqueous solution containing 3 to 5% by volume of ammonium fluoride and 2 to 3% by volume of nitric acid for 20 min.

As a result of this pickling, iron contained in the mill scale formed on the surface of band pieces was oxidized and diffused, so that most of the mill scale was removed. Further; no mill scale was observed on interfaces of mutually neighboring band pieces, pinhole inside walls, and connecting pins for connecting band pieces to each other.

However, the surface of band pieces, namely the surface of the carburized layer formed by the carburization, was roughened by the dissolution of iron caused by the immersion in the acid aqueous solution.

The pickled wristwatch bands were rinsed.

The rinsed wristwatch bands were disposed inside a barrel vessel of a barrel polishing apparatus. Walnut chips and alumina abrasive as polishing mediums were placed in the barrel vessel. A barrel polishing was performed over a period of about 10 hr, thereby removing rough faces formed on the outermost surface of the carburized layer of band pieces.

As a result of this barrel polishing, a region of the carburized layer extending from the surface thereof to a depth of 1 to 2 $\mu$m was removed, and the upper surface of band pieces became a smooth beautiful specular surface required for exterior parts of timepiece. On the upper surface, "orange peel" attributed to minute unevenness was not visible at all.

Observation of a section of band pieces after the barrel polishing through an electron microscope showed that the carburized layer was formed so as to extend from the upper surface of band pieces to a depth of 20 to 30 $\mu$m.

In this Example C5, not only planing of the upper surface of band pieces into a specular surface but also converting of metal crystal grains lying in the vicinity of band piece surface to the fibrous structure can be accomplished by grinding means with a reduced grinding power, thereby enabling reducing the number of production process steps. Therefore, the employment of this grinding enables the lowering of production cost.

Example C6

Cylinders of austenitic stainless steel SUS 316 were provided. The cylinders were cold forged into ring members in such a manner that an external force is applied along the central axis passing through the center of a circular section of the cylinders.

Each of the inner and outer boundary dimensions of the thus forged ring members were adjusted to the desired one by a cutting operation.

Upper surfaces of the resultant ring members were buffed to complete bezels with a specular upper surface.

A section of the buffed bezels was observed through an electron microscope. As a result, it was recognized that metal crystal grains of the stainless steel surface portion were drawn in the direction of buff rotation by the external force applied by buffing, thereby creating a fibrous structure of metal crystal grains deformed in fibrous form. A deformed layer including this fibrous structure was formed so as to extend from the upper surface of bezels to a depth of 3 to 5 $\mu$m.

The bezels were placed in a metallic muffle furnace and heated. The temperature was raised to 480° C., and a fluorogas (mixed gas consisting of 5% by volume of $NF_2$ and 95% by volume of $N_2$) was blown into the muffle furnace for 15 min. Thus, the bezels were fluorinated.

The fluorogas was discharged from the muffle furnace. While blowing a carburizing gas (mixed gas consisting of 10% by volume of CO, 20% by volume of $H_2$, 1% by volume of $CO_2$ and 69% by volume of $N_2$), the bezels were held in the muffle furnace at 480° C. for 12 hr, thereby carburizing the bezels. The bezels were removed from the muffle furnace.

Formation of mill scale was observed on the surface of the bezels having been carburized and taken out.

The bezels were immersed in an acid aqueous solution containing 3 to 5% by volume of ammonium fluoride and 2 to 3% by volume of nitric acid for 20 min.

As a result of this pickling, iron contained in the mill scale formed on the surface of bezels was oxidized and diffused, so that most of the mill scale was removed.

However, the surface of bezels, namely the surface of the carburized layer formed by the carburization, was roughened by the dissolution of iron caused by the immersion in the acid aqueous solution.

The pickled bezels were rinsed.

The rinsed bezels were disposed inside a barrel vessel of a barrel polishing apparatus. Walnut chips and alumina abrasive as polishing mediums were placed in the barrel vessel. A barrel polishing was performed over a period of about 10 hr, thereby removing rough faces formed on the outermost surface of the carburized layer of bezels.

As a result of this barrel polishing, a region of the carburized layer extending from the surface thereof to a depth of 1 to 2 $\mu$m was removed, and the upper surface of bezels became a smooth beautiful specular surface required for exterior parts of timepiece. On the upper surface, "orange peel" attributed to minute unevenness was not visible at all.

Observation of a section of bezels after the barrel polishing through an electron microscope showed that the carburized layer was formed so as to extend from the upper surface of bezels to a depth of 20 to 23 $\mu$m.

What is claimed is:

1. A decorative item comprising:

a basis material of a stainless steel, a carburized hardened layer extending from a surface of the basis material to an arbitrary depth wherein carbon is diffused so as to form a solid solution in which crystalline chromium carbide is not formed, and at least one hard coating disposed on a surface of the carburized hardened layer of the basis material, wherein the hard coating has a surface hardness greater than that of the carburized layer.

2. The decorative item as claimed in claim 1, wherein the hard coating and the basis material at its surface exhibit respective tones which are different from each other.

3. The decorative item as claimed in claim 1, wherein the hard coating is constituted of a nitride, carbide, oxide, nitrido-carbide or nitrido-carbido-oxide of an element belonging to Group 4a, 5a or 6a of the periodic table.

4. The decorative item as claimed in claim 1, wherein the hard coating is a hard coating of carbon.

5. The decorative item as claimed in claim 4, further comprising an intermediate layer disposed between the hard coating of carbon and a surface of the carburized hardened layer of the basis material.

6. The decorative item as claimed in claim 5, wherein the intermediate layer comprises a lower layer of Ti or Cr disposed on the carburized hardened layer surface of the basis material and an upper layer of Si or Ge disposed on a surface of the lower layer.

7. The decorative item as claimed in claim 1, wherein at least two hard coatings are formed on the carburized hardened layer surface of the basis material.

8. The decorative item as claimed in claim 1, wherein at least two hard coatings are laminated on the carburized hardened layer surface of the basis material.

9. The decorative item as claimed in claim 1, wherein the hard coating is disposed on portion of the carburized hardened layer surface of the basis material.

10. The decorative item as claimed in claim 1, further comprising a gold alloy coating disposed on a surface of the hard coating.

11. The decorative item as claimed in claim 10, wherein the gold alloy coating is constituted of an alloy of gold and at least one metal selected from the group consisting of Al, Si, V, Cr, Ti, Fe, Co, Ni, Cu, Zn, Ge, Y, Zr, Nb, Mo, Ru, Rh, Pd, Ag, Cd, In, Sn, Hf, Ta, W, Ir and Pt.

12. The decorative item as claimed in claim 1, which is an exterior part of timepiece.

13. The decorative item as claimed in claim 1, wherein the stainless steel is an austenitic stainless steel.

14. The decorative item as claimed in claim 1, wherein the carburized hardened layer has a specular surface.

15. The decorative item as claimed in claim 1, wherein the hard coating is formed by dry plating.

16. A process for producing a decorative item, comprising the steps of:

providing a basis material of stainless steel, carburizing a surface of the basis material in a carburizing gas atmosphere containing carbon monoxide at 400 to 500° C. to form a carburized hardened layer extending from the surface of the basis material to an arbitrary depth wherein carbon is diffused so as to form a solid solution in which crystalline chromium carbide is not formed, and forming at least one hard coating on a surface of the carburized hardened layer of the basis material, wherein the hard coating has a surface hardness greater than that of the carburized layer.

17. The process as claimed in claim 16, wherein the decorative item is an exterior part of a timepiece.

18. An exterior part of a timepiece, comprising a stainless steel having at its surface a carburized layer wherein carbon is diffused so as to form a solid solution in which crystalline chromium carbide is not formed, wherein the carburized layer has a specular surface obtained by removing rough faces formed on the outermost surface thereof and polishing, and having a Vickers hardness (HV) of 500 or more.

19. An exterior part of a timepiece, comprising a stainless steel having at its surface a carburized layer wherein carbon is diffused so as to form a solid solution in which crystalline chromium carbide is not formed, wherein the carburized layer has a machined surface.

20. The exterior part of timepiece as claimed in claim 19, wherein the machined surface has a Vickers hardness (HV) of 500 or more.

21. The exterior part of timepiece as claimed in claim 20, which is one produced by machining a surface of an exterior part of timepiece and thereafter carburizing the machined surface.

22. The exterior part of a timepiece as claimed in claim 19, wherein the machined surface is a hairline surface or a honing surface.

23. A wristwatch band comprising a plurality of band pieces of stainless steel connected to each other, each of the band pieces having at its surface a carburized layer wherein carbon is diffused so as to form a solid solution in which crystalline chromium carbide is not formed, wherein the carburized layer has a specular surface obtained by removing rough faces formed on the outermost surface thereof and polishing, and having a Vickers hardness (HV) of 500 or more.

24. The wristwatch band as claimed in claim 23, wherein the band pieces are connected to each other by means of connecting parts of stainless steel, each of the connecting parts having on at least a portion of its surface a carburized layer wherein carbon is diffused so as to form a solid solution.

25. The wristwatch band as claimed in claim 23, produced by connecting the band pieces to each other by means of connecting parts, carburizing the band pieces and the connecting parts, and thereafter polishing surfaces of the band pieces.

26. The wristwatch band as claimed in claim 25, which further comprises connecting parts having no carburized layer.

27. A wristwatch band comprising a plurality of band pieces of stainless steel connected to each other, each of the band pieces having at its surface a carburized layer wherein carbon is diffused so as to form a solid solution in which crystalline chromium carbide is not formed, wherein the carburized layer has a machined surface.

28. The wristwatch band as claimed in claim 27, wherein the band pieces are connected to each other by means of connecting parts of stainless steel, each of the connecting parts having at at least a portion of its surface a carburized layer wherein carbon is diffused so as to form a solid solution.

29. The wristwatch band as claimed in claim 27, produced by connecting the band pieces to each other by means of connecting parts, carburizing the band pieces and the connecting parts, and thereafter polishing surfaces of the band pieces.

30. The exterior part of a timepiece as claimed in claim 28, wherein the machined surface is a hairline surface or a honing surface.

31. The wristwatch band as claimed in claim 27, produced by connecting the band pieces to each other by means of connecting parts, carburizing the band pieces and the connecting parts, and thereafter polishing surfaces of the band pieces.

32. The wristwatch band as claimed in claim 27, wherein the band pieces are connected to each other by means of connecting parts of stainless steel, each of the connecting parts having on at least a portion of its surface a carburized layer wherein carbon is diffused so as to form a solid solution.

33. A process for producing a wristwatch band, comprising the steps of:

connecting a plurality of band pieces of stainless steel to each other by means of a plurality of connecting parts of stainless steel;

fluorinating the band pieces and the connecting parts in a fluorogas atmosphere at 400 to 500° C.;

gas carburizing the fluorinated band pieces and connecting parts in a carburizing gas atmosphere containing carbon monoxide at 400 to 500° C. to form a carburized hardened layer extending from the surface of the fluorinated band pieces and connecting parts to an arbitrary depth wherein carbon is diffused so as to form a solid solution in which crystalline chromium carbides is not formed;

pickling the carburized band pieces and connecting parts, followed by rinsing; and subjecting surfaces of the band pieces to barrel polishing.

34. The process as claimed in claim 33, which further comprises buffing the band piece surfaces having undergone barrel polishing.

35. The process as claimed in claim 33, which further comprises machining surfaces of the band pieces connected by means of the connecting parts prior to the fluorination to obtain a wristwatch band having machined surfaces.

36. The process as claimed in claim 34, which further comprises machining surfaces of the band pieces connected by means of the connecting parts prior to the fluorination to obtain a wristwatch band having machined surfaces.

37. A process for producing a wristwatch band, comprising the steps of:

fluorinating a plurality of band pieces of stainless steel and a plurality of connecting parts of stainless steel in a fluorogas atmosphere at 250 to 600° C.;

gas carburizing the fluorinated band pieces and connecting parts in a carburizing gas atmosphere containing carbon monoxide at 400 to 500° C. to form a carburized hardened layer extending from the surface of the fluorinated band pieces ad connecting parts to an arbitrary depth wherein carbon is diffused so as to form a solid solution in which crystalline chromium carbides is not formed;

pickling the carburized band pieces and connecting parts, followed by rinsing;

subjecting surfaces of the band pieces to barrel polishing; and connecting the band pieces by means of the connecting parts.

38. The process as claimed in claim 37, which further comprises buffing the band piece surfaces having undergone barrel polishing.

39. The process as claimed in claim 38, which further comprises machining surfaces of the plurality of band pieces prior to the fluorination to obtain a wristwatch band having machined surfaces.

40. The process as claimed in claim 37, which further comprises machining surfaces of the plurality of band pieces prior to the fluorination to obtain a wristwatch band having machined surfaces.

41. A process for producing an exterior part of a timepiece other than a wristwatch band, comprising the steps of:

connecting a plurality of pieces of stainless steel to each other by means of a plurality of connecting parts of stainless steel to obtain a base material for a timepiece exterior part of stainless steel other than a wristwatch band;

fluorinating the base material in a fluorogas atmosphere at 250 to 600° C.;

gas carburizing the fluorinated base material in a carburizing gas atmosphere containing carbon monoxide at 400 to 500° C. to form a carburized hardened layer extending from the surface of the fluorinated base material to an arbitrary depth wherein carbon is diffused so as to form a solid solution in which crystalline chromium carbides is not formed;

pickling the carburized base material, followed by rinsing; and subjecting surfaces of the base material to barrel polishing.

42. The process as claimed in claim 41, which further comprises buffing the base material surfaces having undergone barrel polishing.

43. The process as claimed in claim 42, which further comprises machining surfaces of the base material prior to the fluorination to obtain an exterior part of timepiece other than wristwatch band having machined surfaces.

44. The process as claimed in claim 41, which further comprises machining surfaces of the base material prior to the fluorination to obtain an exterior part of timepiece other than wristwatch band having machined surfaces.

45. The exterior part of a timepiece as claimed in claim 18, wherein a region of the carburized layer extending from the surface thereof has a depth of from 1 to 2 $\mu$m.

46. An exterior part of a timepiece, comprising a stainless steel having at its surface a carburized layer wherein carbon is diffused so as to form a solid solution in which crystalline chromium carbide is not formed, wherein a machined surface formed before carburization is provided on the carburized layer surface.

* * * * *

UNITED STATES PATENT AND TRADEMARK OFFICE

CERTIFICATE OF CORRECTION

PATENT NO. : 6,905,758 B1
DATED : June 14, 2005
INVENTOR(S) : Kushida et al.

It is certified that error appears in the above-identified patent and that said Letters Patent is hereby corrected as shown below:

Title Page,
Item [56], References Cited, U.S. PATENT DOCUMENTS, insert the following:
-- 5,985,469 11-1999 Kurakata et al. --.
FOREIGN DOCUMENTS, insert the following:
-- JP 62199765 09-1987 --.
Item [57], ABSTRACT,
Line 4, “hardened later” should read -- hardened layer --.

Column 5,
Line 28, “material is pr4eferably” should read -- material is preferably --.
Line 48, “basis base material” should read -- base material --.

Column 11,
Line 57, “basis base material” should read -- base material --.

Column 12,
Line 30, “basis base material” should read -- base material --.
Line 44, “basis base material” should read -- base material --.

Column 16,
Line 10, “connecting pails” should read -- connecting parts --.

Column 24,
Line 15, “is thus exce3llent” should read -- is thus excellent --.

Column 44,
Line 18, “at at least a portion” should read -- on at least a portion --.

UNITED STATES PATENT AND TRADEMARK OFFICE

CERTIFICATE OF CORRECTION

PATENT NO. : 6,905,758 B1
DATED : June 14, 2005
INVENTOR(S) : Kushida et al.

It is certified that error appears in the above-identified patent and that said Letters Patent is hereby corrected as shown below:

Column 45,
Line 12, "pieces ad connecting" should read -- pieces and connecting --.

Signed and Sealed this

Seventh Day of February, 2006

JON W. DUDAS
*Director of the United States Patent and Trademark Office*